US008483599B2

(12) United States Patent
Okuma et al.

(10) Patent No.: US 8,483,599 B2
(45) Date of Patent: Jul. 9, 2013

(54) POWDER CONTAINER, POWDER PROCESSING APPARATUS USING THE SAME, AND POWDER CONTAINER CONTROLLING METHOD

(75) Inventors: Hiroaki Okuma, Kanagawa (JP); Takashi Sakamoto, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 259 days.

(21) Appl. No.: 13/095,483

(22) Filed: Apr. 27, 2011

(65) Prior Publication Data

US 2012/0132559 A1 May 31, 2012

(30) Foreign Application Priority Data

Nov. 25, 2010 (JP) ..... 2010-262274

(51) Int. Cl.
*G03G 15/08* (2006.01)

(52) U.S. Cl.
USPC ..... 399/260; 399/262; 222/DIG. 1

(58) Field of Classification Search
USPC ..... 399/260, 262
See application file for complete search history.

(56) References Cited

FOREIGN PATENT DOCUMENTS

JP 2008-298879 A 12/2008

*Primary Examiner* — Walter L Lindsay, Jr.
*Assistant Examiner* — Benjamin Schmitt
(74) *Attorney, Agent, or Firm* — Sughrue Mion, PLLC

(57) ABSTRACT

A powder container includes an open/close lid that closes an opening partly formed in a container body corresponding to a powder opening of a container receiver; a first restricting portion that, upon attachment of the container body to the container receiver, contacts a contact surface formed upstream of the powder opening to restrict a position of the lid in an open/close operation direction thereof; a flexible sealing member that protrudes from an opening-side edge of an open position, and closes an opening-side portion of a gap between the contact surface and the first restricting portion; and a second restricting portion that, upon detachment of the container body, when a press member restricts movement of the lid, restricts a posture of the sealing member so as to be pressed against an edge portion of the powder opening at a position where the first restricting portion contacts the contact surface.

16 Claims, 35 Drawing Sheets

POWDER CONTAINER, POWDER PROCESSING APPARATUS USING THE SAME, AND POWDER CONTAINER CONTROLLING METHOD

CROSS-REFERENCE TO RELATED APPLICATIONS

This application is based on and claims priority under 35 USC 119 from Japanese Patent Application No. 2010-262274 filed Nov. 25, 2010.

BACKGROUND

The present invention relates to a powder container, a powder processing apparatus using the powder container, and a powder container controlling method.

SUMMARY

According to an aspect of the invention, there is provided a powder container that is detachably attached to a container receiver of a powder processing apparatus casing and that houses powder. The powder container includes a container body that houses the powder, the container body having an opening that is formed in a portion of the container body at a position corresponding to a powder opening that is formed in the container receiver; an open/close lid that is movable between an open position at which the opening is open and a close position at which the opening is closed; a first restricting portion that is provided at a portion of the open/close lid at a position at a forward side in an attachment operation direction of the container body, a contact surface being located upstream of the powder opening of the container receiver in the attachment operation direction of the container body and being formed to intersect with an open/close operation direction of the open/close lid, the first restricting portion being formed to face the contact surface, when the container body is attached to the container receiver, the first restricting portion being configured to contact the contact surface to restrict a position of the open/close lid in the open/close operation direction of the open/close lid; a flexible sealing member having a protruding free end that protrudes from an edge of the open/close lid near the opening when the open/close lid is located at the open position at which the opening is open, the protruding free end contacting an edge portion of the powder opening and closing a portion, which is located near the opening, of a gap between the contact surface and the first restricting portion; and a second restricting portion, a press member being provided at the container receiver and restricting movement of the open/close lid in a detachment direction of the container body until the open/close lid reaches the close position at which the opening is closed, when the container body is detached from the container receiver and when the press member restricts the movement of the open/close lid, the second restricting portion being configured to restrict a posture of the sealing member such that the protruding free end of the sealing member is pressed against the edge portion of the powder opening at a position at which the first restricting portion contacts the contact surface.

BRIEF DESCRIPTION OF THE DRAWINGS

Exemplary embodiment(s) of the present invention will be described in detail based on the following figures, wherein.

DETAILED DESCRIPTION

Overview of Exemplary Embodiment

Figure 1A:
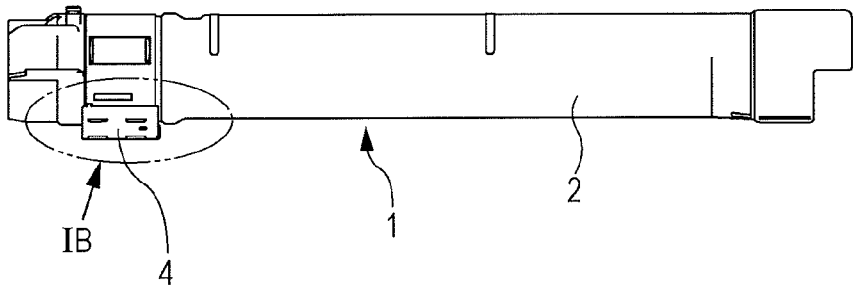
FIG. 1A is an explanatory view showing an overview of a powder container according to an exemplary embodiment to which the present invention is applied.

FIG. 1A shows an overview of an exemplary embodiment of a powder container to which the present invention is applied.

Figure 1B:
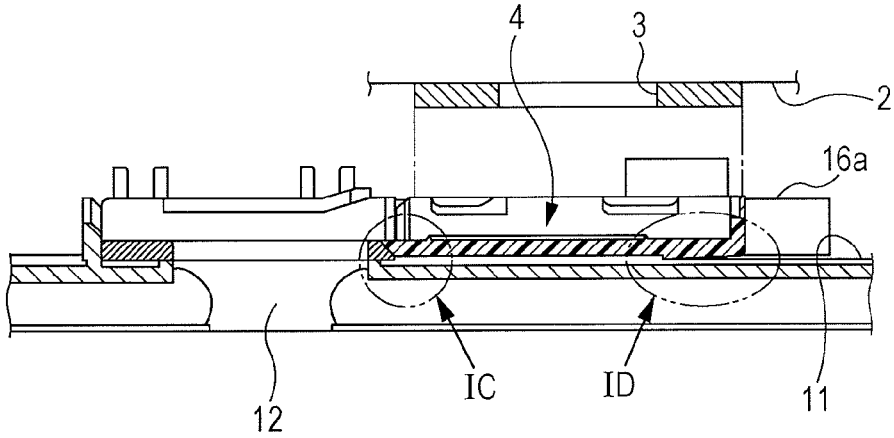
FIG. 1B is an explanatory view showing the detail of part IB in FIG. 1A.
Figure 1C:
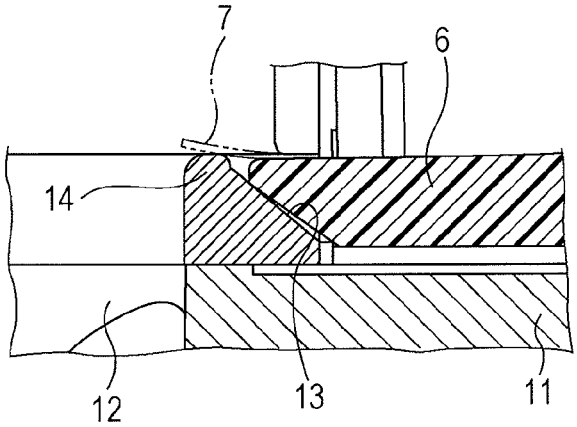
FIG. 1C is an explanatory view showing part IC in FIG. 1B.
Figure 1D:
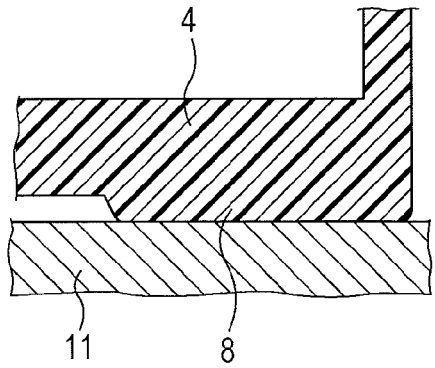
FIG. 1D is an explanatory view showing part ID in FIG. 1B.

As shown in FIGS. 1A and 1B, a powder container 1 is a powder container that is detachably attached to a container receiver 11 (see FIG. 1B) of a powder processing apparatus casing and that houses powder. The powder container 1 includes a container body 2 that houses the powder, an opening 3 that is formed in a portion of the container body 2 at a position corresponding to a powder opening 12 (see FIG. 1B) that is formed in the container receiver 11, and an open/close lid 4 that is movable between an open position at which the opening 3 is open and a close position at which the opening 3 is closed.

Particularly in this exemplary embodiment, as shown in FIGS. 1A to 1D, the powder container 1 includes a first restricting portion 6 that is provided at a portion of the open/close lid 4 at a position at a forward side in an attachment operation direction of the container body 2, a contact surface 13 being located upstream of the powder opening 12 of the container receiver 11 in the attachment operation direction of the container body 2 and being formed to intersect with an open/close operation direction of the open/close lid 4, the first restricting portion 6 being formed to face the contact surface 13, when the container body 2 is attached to the container receiver 11, the first restricting portion 6 being configured to contact the contact surface 13 to restrict a position of the open/close lid 4 in the open/close operation direction of the open/close lid 4; a flexible sealing member 7 having a protruding free end that protrudes from an edge of the open/close lid 4 near the opening 3 when the open/close lid 4 is located at the open position at which the opening 3 is open, the protruding free end contacting an edge portion 14 of the powder opening 12 and closing a portion, which is located near the opening 3, of a gap between the contact surface 13 and the first restricting portion 6; and a second restricting portion 8, a press member 16*a* being provided at the container receiver 11 and restricting movement of the open/close lid 4 in a detachment direction of the container body 2 until the open/close lid 4 reaches the close position at which the opening 3 is closed, when the container body 2 is detached from the container receiver 11 and when the press member 16*a* restricts the movement of the open/close lid 4, the second restricting portion 8 being configured to restrict a posture of the sealing member 7 such that the protruding free end of the sealing member 7 is pressed against the edge portion 14 of the powder opening 12 at a position at which the first restricting portion 6 contacts the contact surface 13.

In this technical measure, the powder container 1 may be a container that houses powder. Housing powder includes an exemplary embodiment of housing unused powder and an exemplary embodiment of recovering and housing used powder.

A powder processing apparatus may be any apparatus that includes the powder container 1 as a component and performs processing with powder.

Here, representative exemplary embodiments of the powder container 1 and the powder processing apparatus may be a developer container and an image forming apparatus that use a developer as the powder.

An attachment method of the powder container 1 may be representatively a method of inserting the powder container 1 in a direction facing a vertical wall extending in a vertical direction of the powder processing apparatus casing (not shown) (hereinafter, this direction is occasionally referred to as horizontal direction). The attachment method also includes a method of inserting the powder container 1 in the horizontal direction and then rotating the powder container 1.

An exemplary embodiment in which the container body 2 is long in the attachment operation direction is representative. However, it is not limited thereto, and other shape may be properly selected.

An exemplary embodiment having therein a stirring member that is able to be driven by, for example, an external drive source is desirable to avoid a situation in which the powder (for example, the developer) housed in the container body 2 from locally becoming a block because of environmental change or temporal change. If the container body 2 having therein, for example, the stirring member or the like, the container body 2 may include a cylindrical container body, in which at least one of ends is open, and an end lid member that closes the end opening.

The open/close lid 4 is only required to be movable relative to the opening 3 of the container body 2. The open/close operation direction of the open/close lid 4 represents a direction in which the powder container 1 (or the container body 2) is operated when the open/close lid 4 is opened or closed to attach or detach the powder container (or the container body 2).

The container receiver 11 is only required to have at least the powder opening 12. An open/close lid that opens and closes the powder opening 12 may be provided as required. The contact surface 13 may be an inclined surface that is located upstream of the powder opening 12 in the attachment operation direction of the container body 2 and inclined with respect to the open/close operation direction of the open/close lid 4 such that a height of the inclined surface is decreased as the inclined surface extends away from the powder opening 12, or may be a vertical surface that is orthogonal to the open/close operation direction of the open/close lid 4. The contact surface 13 is not particularly limited; however, an inclined surface at an angle in a range from 30° to 60° with respect to the vertical surface may be properly selected. In an exemplary embodiment in which the contact surface 13 has an inclined surface, an inclination angle of the first restricting portion 6 and an inclination angle of the contact surface 13 do not have to be equivalent to each other. However, with an exemplary embodiment in which these angles are equivalent to each other, a gap between the first restricting portion 6 and the contact surface 13 may be decreased.

Since the sealing member 7 is flexible, when the container body 2 is attached, if a distal end of the sealing member 7 contacts the contact surface 13, the sealing member 7 is separated from the contact surface 13 due to the inclined surface of the contact surface 13 and the flexural rigidity of the sealing member 7, and moves to a position at which the sealing member 7 closes the gap between the contact surface 13 and the first restricting portion 6.

The second restricting portion 8 is only required to restrict the posture of the sealing member 7 such that the protruding free end of the sealing member 7 is pressed against the edge portion 14 of the powder opening 12. A representative example may be an exemplary embodiment that restricts the posture of the entire open/close lid 4 by using a protruding portion, a bulged portion, or an extending portion, which protrudes from an outer surface of the open/close lid 4 to restrict the posture of the sealing member 7, or an exemplary embodiment in which a mount surface for the sealing member 7 at the open/close lid 4 is an inclined surface that is inclined forward toward the powder opening 12.

Next, a representative exemplary embodiment or a desirable exemplary embodiment of the powder container according to this exemplary embodiment is described.

A representative exemplary embodiment of the attachment method of the powder container 1 is the insertion method in the horizontal direction. The insertion method in the horizontal direction is an exemplary embodiment in which the container receiver 11 of a powder processing apparatus casing 10 (see FIG. 2) extends in the direction facing the vertical wall extending in the vertical direction of the powder processing apparatus casing 10, and the attachment operation direction of the container body 2 to the container receiver 11 is a direction in which the container body 2 is inserted along the container receiver 11.

Representative exemplary embodiments of the second restricting portion 8 may be an exemplary embodiment in which the second restricting portion 8 is provided on an outer surface, which faces the container receiver 11, of the open/close lid 4 at a portion, which is apart from the first restricting portion 6, protrudes toward and contacts the container receiver 11, and restricts the posture of the sealing member 7 by causing the posture of the open/close lid 4 with respect to the container receiver 11 to be inclined forward toward the first restricting portion 6; or an exemplary embodiment in which a mount surface for the sealing member 7 at the open/close lid 4 is an inclined surface that is inclined forward toward the powder opening 12, and hence restricts the posture of the sealing member 7.

In particular, in an exemplary embodiment in which the open/close lid 4 is inclined forward toward the first restricting portion 6 to serve as the second restricting portion 8, the container receiver 11 desirably has the contact surface 13 that is located upstream of the powder opening 12 in the attachment operation direction of the container body 2 and is inclined with respect to the open/close operation direction of the open/close lid 4 such that a height of the contact surface 13 is decreased as the contact surface 13 extends away from the powder opening 12. Also, the first restricting portion 6 desirably has the inclined surface that is inclined with respect to the open/close operation direction to face the contact surface 13.

In this exemplary embodiment, the second restricting portion 8 restricts the posture of the sealing member 7 by restricting the posture of the open/close lid 4. By the second restricting portion 8 in the two ways, the first restricting portion 6 may be pressed against the contact surface 13 in a direction in which the first restricting portion 6 is tilted down. Accordingly, even if the open/close lid 4 is slightly retracted from the contact surface 13 due to a manufacturing error, the contact surface 13 maintains a state in which a distal end of the first restricting portion 6 contacts the contact surface 13. Therefore, the gap between the contact surface 13 and the first restricting portion 6 is closed with the sealing member 7, and is closed because of the tilting down behavior of the first restricting portion 6.

Also, a desirable exemplary embodiment of the container body 2 may be an exemplary embodiment in which the edge of the opening 3 of the container body 2 has an elastic close-contact member (not shown) that contacts the edge portion 14 of the powder opening 12, and the protruding free end of the sealing member 7 is able to be inserted between the close-contact member and the edge portion 14 of the powder opening 12.

In this exemplary embodiment, when the powder container 1 is detached, the opening 3 of the container body 2 passes the edge portion 14 of the powder opening 12 of the container receiver 11 while the opening 3 is exposed. Hence, the edge portion 14 of the powder opening 12 is contaminated. At this time, with the exemplary embodiment additionally provided with the sealing member 7, even if the powder is dropped from the opening 3 of the container body 2 and the edge portion 14 of the powder opening 12 is contaminated, the sealing member 7 scrapes the powder and the close-contact member wipes the contamination on a back surface of the sealing member 7.

Figure 2:
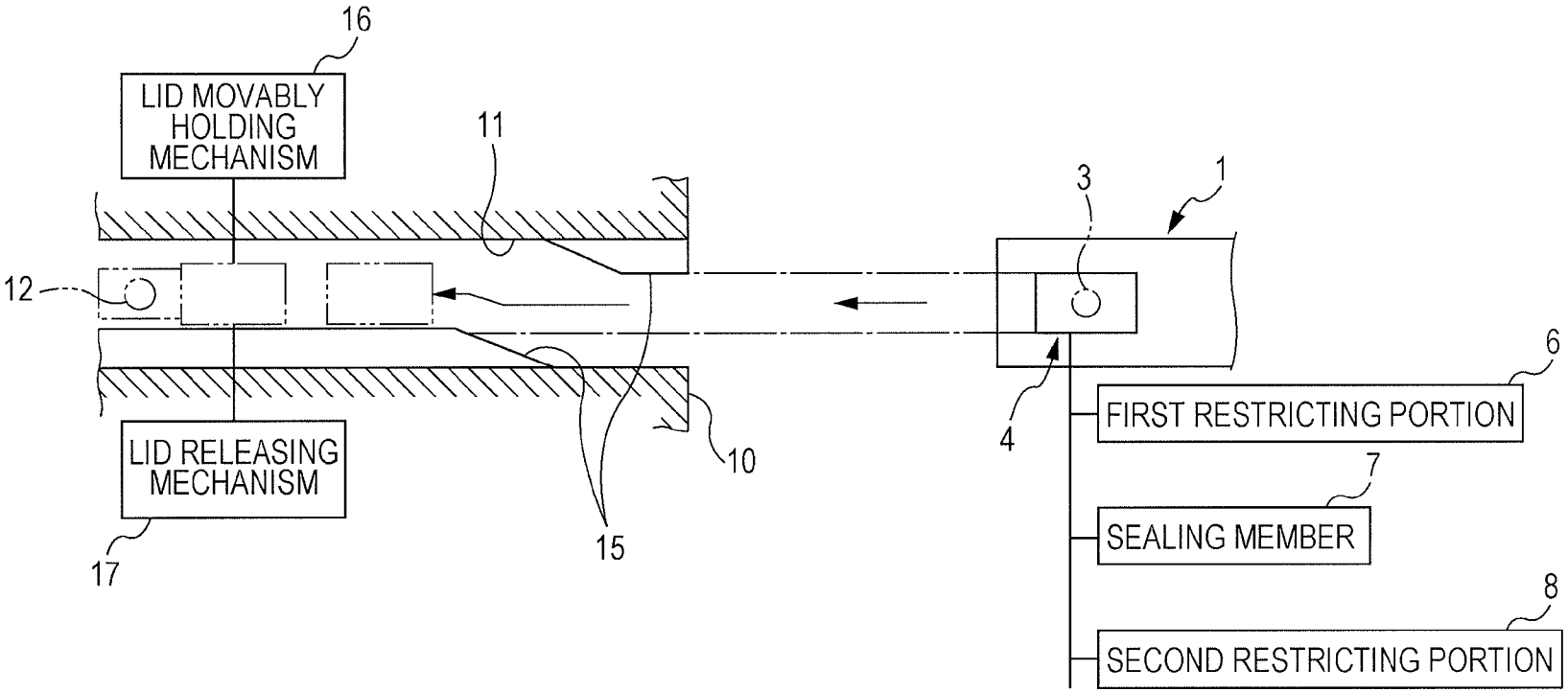
FIG. 2 is an explanatory view showing an overview of a powder processing apparatus using the powder container according to the exemplary embodiment shown in FIGS. 1A to 1D.

Also, if an exemplary embodiment of the powder processing apparatus is constructed by using the powder container 1 according to this exemplary embodiment, as shown in FIG. 2, only required to be provided are a powder processing apparatus casing 10 including a container receiver 11, and a powder container 1 that is detachably attached to the container receiver 11 and houses the powder.

Alternatively, with this powder processing apparatus, the second restricting portion 8 may be added not to the powder container 1, but to the container receiver 11.

In this exemplary embodiment, the powder container 1 includes a container body 2 that houses the powder, the container body 2 having an opening 3 that is formed in a portion of the container body 2 at a position corresponding to a powder opening 12 that is formed in the container receiver 11; an open/close lid 4 that is movable between an open position at which the opening 3 is open and a close position at which the opening 3 is closed; a first restricting portion 6 that is provided at a portion of the open/close lid 4 at a position at a forward side in an attachment operation direction of the container body 2, a contact surface 13 being located upstream of the powder opening 12 of the container receiver 11 in the attachment operation direction of the container body 2 and being formed to intersect with an open/close operation direction of the open/close lid 4, the first restricting portion 6 being formed to face the contact surface 13, when the container body 2 is attached to the container receiver 11, the first restricting portion 6 being configured to contact the contact surface 13 to restrict a position of the open/close lid 4 in the open/close operation direction of the open/close lid 4; and a flexible sealing member 7 having a protruding free end that protrudes from an edge of the open/close lid 4 near the opening 3 when the open/close lid 4 is located at the open position at which the opening 3 is open, the protruding free end contacting an edge portion 14 of the powder opening 12 and hence closing a portion, which is located near the opening 3, of a gap between the contact surface 13 and the first restricting portion 6. Also, the container receiver 11 of the powder processing apparatus casing 10 includes a press member 16*a* that, when the container body 2 is detached from the container receiver 11, restricts movement of the open/close lid 4 in a detachment direction of the container body 2 until the open/close lid 4 reaches the close position at which the opening 3 is closed; and a second restricting portion 8 that, when the container body 2 is detached from the container receiver 11 and when the press member 16*a* restricts the movement of the open/close lid 4, restricts a posture of the sealing member 7 such that the protruding free end of the sealing member 7 is pressed against the edge portion 14 of the powder opening 12 at a position at which the first restricting portion 6 contacts the contact surface 13.

Further, as shown in FIG. 2, a desirable exemplary embodiment of the powder processing apparatus may be an exemplary embodiment in which the container receiver 11 of the powder processing apparatus casing 10 includes a lid guide rail 15 that guides a moving path of the open/close lid 4 of the powder container 1; a lid movably holding mechanism 16 that contacts the open/close lid 4, moves the open/close lid 4 toward the open position, and then holds the open/close lid 4 when the attachment of the powder container 1 is completed, and also moves the open/close lid 4 at the open position toward the close position by pressing the open/close lid 4 by the press member 16*a* when the powder container 1 is detached; and a lid releasing mechanism 17 that releases a holding state by the lid movably holding mechanism 16 when the powder container 1 is detached and when the open/close lid 4 has reached the close position.

Here, the lid guide rail 15 may be a continuously provided rail member, or a structure implementing a rail function for guiding the open/close lid 4 by using a wall member or a guide block member.

Also, the lid movably holding mechanism 16 is only required to implement a function of moving the open/close lid 4 toward the open position and holds the position during the attachment operation of the powder container 1, and moving the open/close lid 4 from the open position toward the close position during the detachment operation. Further, the lid releasing mechanism 17 is only required to implement a function of releasing the holding state of the open/close lid 4 by the lid movably holding mechanism 16 when the powder container 1 is removed.

Further, a desirable exemplary embodiment of the powder processing apparatus including the above-described lid movably holding mechanism 16 and the sealing member 7 may be an exemplary embodiment in which a>b is satisfied, where b is a gap between the open position of the open/close lid 4 provided by the lid movably holding mechanism 16 and the open/close lid 4, and a is a protruding length of the sealing member 7 from a contact portion of the sealing member 7 with respect to the edge portion 14 of the powder opening 12 when the first restricting portion 6 of the open/close lid 4 contacts the contact surface 13.

In this exemplary embodiment, the gap generated between the contact surface 13 and the first restricting portion 6 of the open/close lid 4 becomes equivalent to the gap b between the open position of the open/close lid 4 provided by the lid movably holding mechanism 16 and the open/close lid 4 at maximum. Hence, if a>b is satisfied, the sealing member 7 may close the gap b between the contact surface 13 and the first restricting portion 6.

Hereinafter, the present invention will be described in more detail based on exemplary embodiments shown in the accompanying drawings.

First Exemplary Embodiment

Entire Configuration of Image Forming Apparatus

Figure 3:
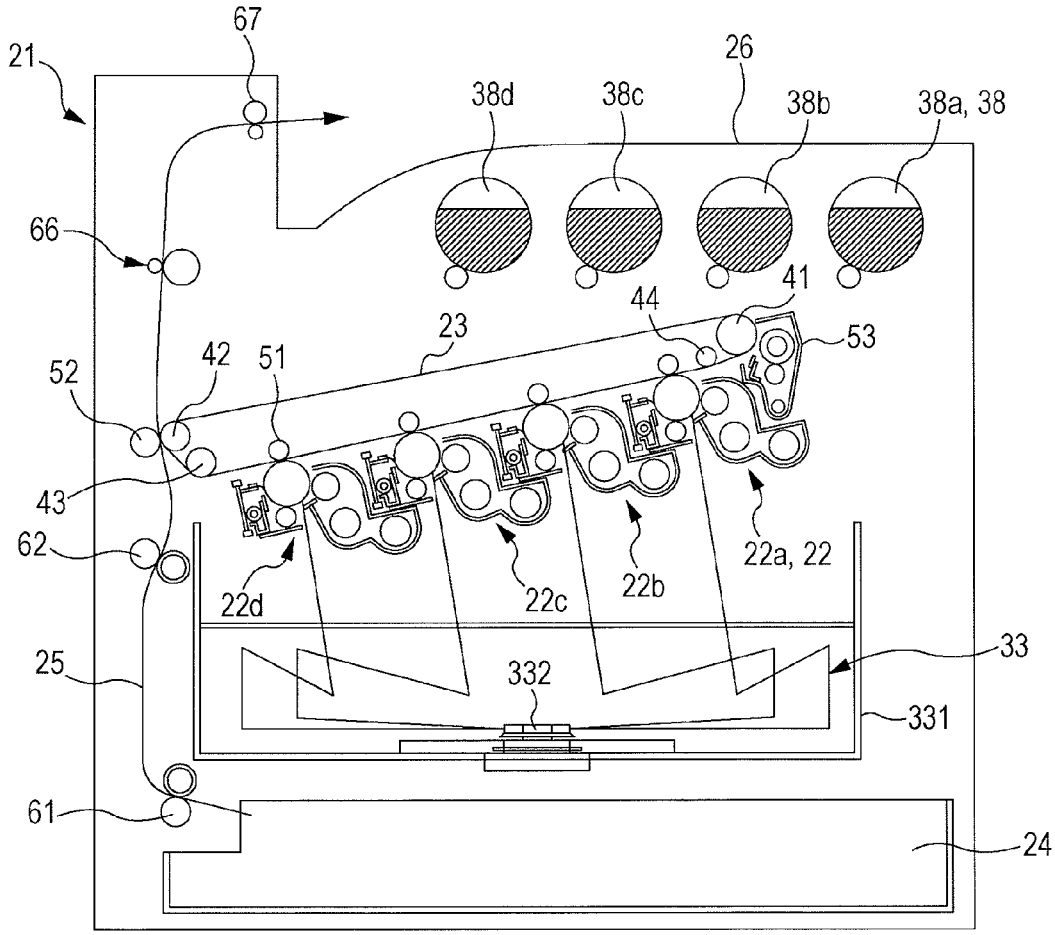
FIG. 3 is an explanatory view showing an entire configuration of an image forming apparatus as a powder processing apparatus according to a first exemplary embodiment to which the present invention is applied.

FIG. 3 shows an entire configuration of a first exemplary embodiment of an image forming apparatus serving as a powder processing apparatus to which the present invention is applied.

Referring to FIG. 3, the image forming apparatus includes, in an image forming apparatus casing (hereinafter, referred to as apparatus casing) 21, image forming units 22 (specifically, 22*a* to 22*d*) of four colors (in this exemplary embodiment, black, yellow, magenta, cyan) arranged across the inside of the apparatus casing 21 such that the image forming units 22 are slightly inclined toward an obliquely upper side with respect to the horizontal direction; an intermediate transfer belt 23 that is arranged above the image forming units 22 and that rotates and moves along an arrangement direction of the image forming units 22; a recording material feed device 24, in which the recording material is stacked in a feedable manner, is arranged in a lower portion of the apparatus casing 21; and a recording material output receiver 26 at an upper portion of the apparatus casing 21, a recording material after image formation being output and stacked onto the recording material output receiver 26. The recording material from the recording material feed device 24 passes through a recording material transport path 25 extending along the vertical direction and is output onto the recording material output receiver 26.

Figure 4:
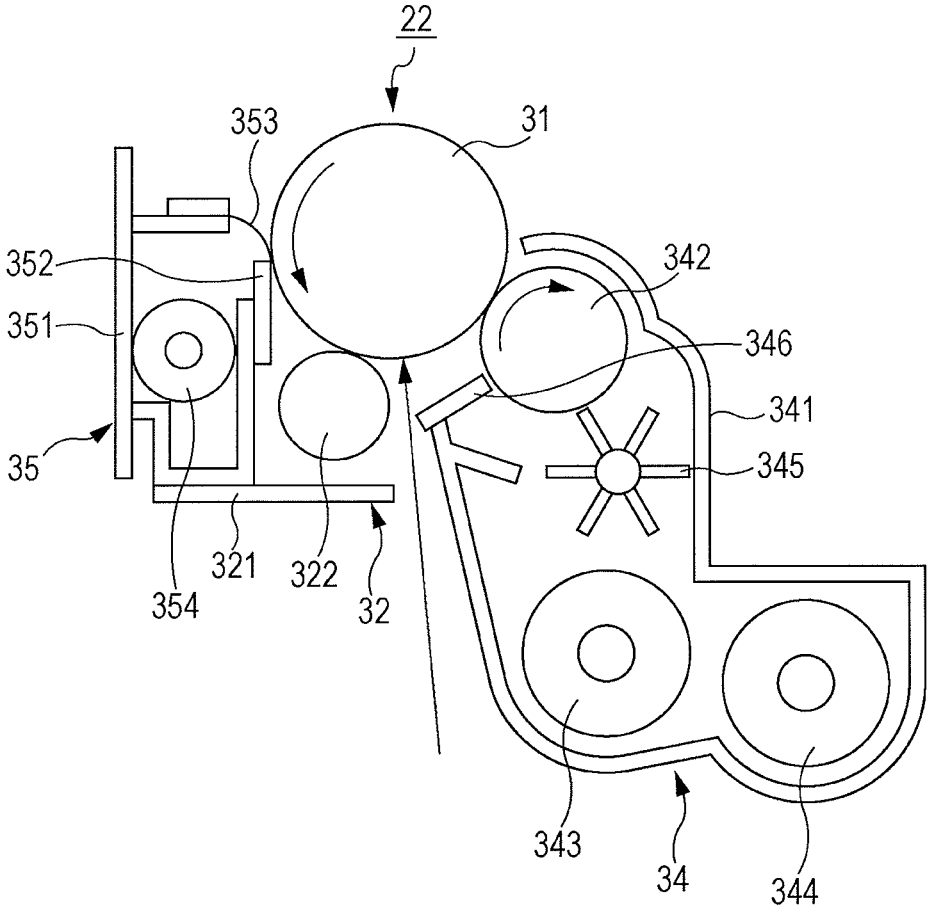
FIG. 4 is an explanatory view showing the detail of an image forming unit of the image forming apparatus shown in FIG. 3.

In this exemplary embodiment, as shown in FIGS. 3 and 4, the image forming units 22 (22*a* to 22*d*) form toner images of, for example, black, yellow, magenta, and cyan in order from an upstream side in a rotation direction of the intermediate transfer belt 23 (the order of the arrangement is not limited to the aforementioned order). For example, the image forming units 22 each include a drum-shaped photoconductor 31, a charging unit 32 that previously electrically charges the photoconductor 31, an exposure unit 33 that writes an electrostatic latent image on the photoconductor 31 electrically charged by the charging unit 32, a developing unit 34 that visualizes the electrostatic latent image on the photoconductor 31 by a toner of each color, and a cleaner 35 that cleans a residual toner on the photoconductor 31.

The exposure unit 33 is commonly used for the respective image forming units 22. Light from a light source, such as a semiconductor laser (not shown), of each color component is deflected by a deflection mirror 332 for scanning with the light in an exposure container 331, and guides a light image to an exposure position on the corresponding photoconductor 31 through an imaging lens and a mirror (both not shown).

The intermediate transfer belt 23 is supported by support rollers 41 to 44, and is rotated and moved by, for example, the support roller 41 as a driving roller. A first transfer unit 51 (for example, first transfer roller) is arranged on a back surface of the intermediate transfer belt 23 at a position corresponding to each photoconductor 31. By applying a voltage with a polarity opposite to a charging polarity of the toner to the first transfer unit 51, the toner image on the photoconductor 31 is electrostatically transferred to the intermediate transfer belt 23.

A second transfer unit 52 (for example, second transfer roller) is arranged at a portion corresponding to the support roller 42 at a downstream side of the image forming unit 22*d*, which is located at the most downstream in a moving direction of the intermediate transfer belt 23. First transfer images on the intermediate transfer belt 23 are secondarily transferred (collectively transferred) on a recording material.

An intermediate cleaner 53 is provided at a portion corresponding to the support roller 41 at a downstream side of the second transfer portion of the intermediate transfer belt 23. The intermediate cleaner 53 cleans a residual toner on the intermediate transfer belt 23.

The intermediate transfer belt 23 is formed by adding an anti-static agent such as carbon black by a certain amount to resin, such as polyimide, polycarbonate, polyester, or polypropylene, or a kind of rubber, so as to have a volume resistivity in a range from $10^6$ to $10^{14}$ Ω·cm.

In this exemplary embodiment, a recording material fed by a feeder 61 of the recording material feed device 24 is transported to a certain number of transport rollers (not shown) provided in the recording material transport path 25, is registered by a registration roller 62, and then passes through the second transfer portion of the second transfer unit 52. An unfixed toner image is fixed to the recording material by heat and pressure by a fixing unit 66, and then the recording material is output and stacked onto the recording material output receiver 26 through an output roller 67.

In FIG. 3, reference numeral 38 (38*a* to 38*d*) denotes a developer container that supplies a new developer (in this exemplary embodiment, toner) to the developing unit 34 of each of the image forming units 22 (22*a* to 22*d*).

Image Forming Unit

Particularly in this exemplary embodiment, as shown in FIG. 4, the photoconductor 31 is configured as a process cartridge in which the charging unit 32 and the cleaner 35 are integrated. The process cartridge is removably mounted on the apparatus casing 21, and defines part of the image forming unit 22 of each color component.

The charging unit 32 includes a charging container 321, and a charging roller 322. The charging container 321 has an opening portion facing the photoconductor 31. The charging roller 322 is arranged in the charging container 321, and is in contact with or is located near the surface of the photoconductor 31.

The cleaner 35 includes a cleaning container 351, a cleaning blade 352, an elastic sealing member 353, and a leveling transport member 354. The cleaning container 351 has an opening portion facing the photoconductor 31. The cleaning blade 352 is provided at an edge portion of the opening along the longitudinal direction of the cleaning container 351, and is formed of an elastic scraping plate that contacts the photoconductor 31. The elastic sealing member 353 is provided at another edge portion of the opening along the longitudinal direction of the cleaning container 351, and contacts the photoconductor 31. The leveling transport member 354 is arranged in the cleaning container 351, and levels a residual matter, such as a toner scraped by the cleaning blade 352, along the longitudinal direction.

Further, in this exemplary embodiment, the developing unit 34 is mounted on the apparatus casing 21 separately from the process cartridge. The developing unit 34 includes a developing container 341 that has an opening portion facing the photoconductor 31, and housing a developer containing at least a toner. A developer holder 342 is arranged at the opening portion of the developing container 341, and is capable of transporting the developer toward a developing region located at the facing portion to the photoconductor 31. A pair of developer stirring and transporting members 343 and 344 is arranged in the developing container 341 at a rear surface side of the developer holder 342, and is capable of stirring and transporting the developer while circulating the developer. A developer feed member 345 is provided between the developer holder 342 and the developer stirring and transporting member 343 located near the developer holder 342, and is capable of feeding the stirred and transported developer toward the developer holder 342. In addition, a layer thickness restricting member 346 restricts a layer thickness of the developer fed to the developer holder 342 to be a predetermined layer thickness. Then, the developer is fed to the developing region.

Developer Supply System

Figure 5:
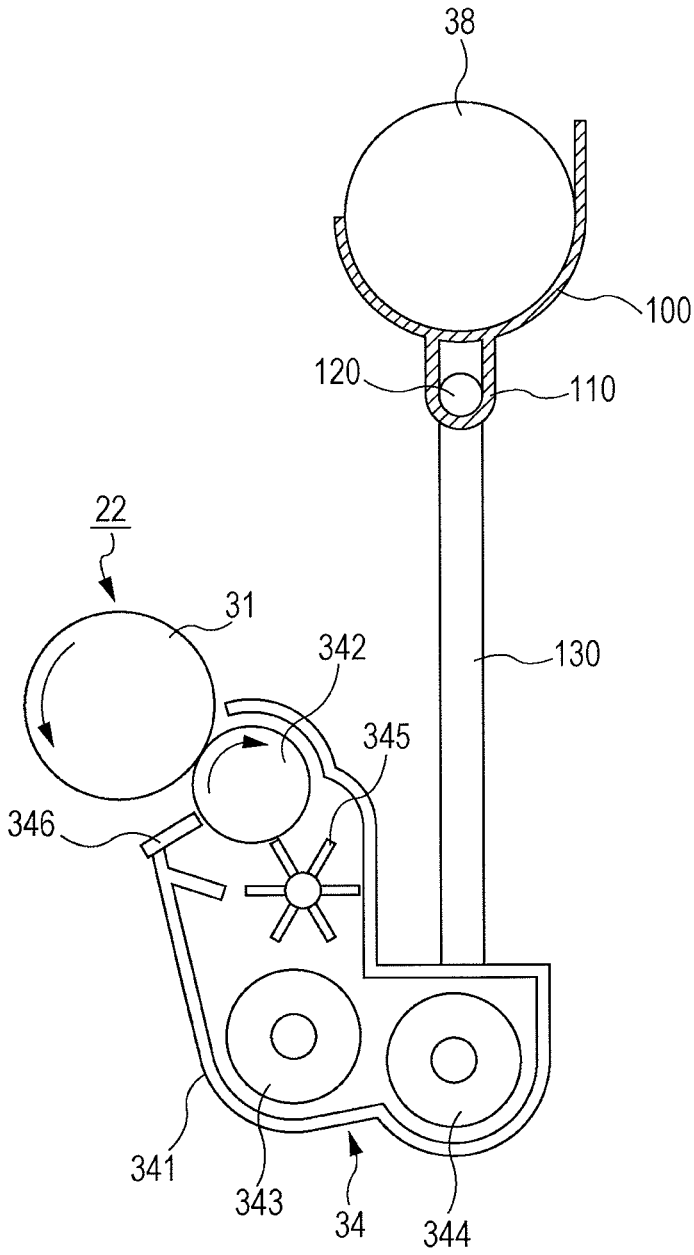
FIG. 5 is an explanatory view showing an example of a container receiver of a developer container as a powder container used in the image forming apparatus shown in FIG. 3.

FIG. 5 shows an example of a developer supply system used in this exemplary embodiment.

Referring to FIG. 5, the developer supply system includes a container receiver 100 formed at a portion of the apparatus casing 21. The developer container 38 is detachably attached to the container receiver 100. A reserve tank 110 is arranged below the container receiver 100. The reserve tank 110 temporarily reserves the developer for supply. The container receiver 100 has a discharge port (not shown) through which the developer in the developer container 38 is able to be discharged when the developer container 38 is attached, and also has a quantitative stirring and transporting member 120 in the reserve tank 110. The quantitative stirring and transporting member 120 is able to feed the reserved developer by a constant amount. The quantitative stirring and transporting member 120 supplies the developer by a predetermined amount into the developing container 341 of the developing unit 34 through a duct 130 that is coupled to a portion of the reserve tank 110, in accordance with density information indicative of, for example, decrease in developing density.

Developer Container

In this exemplary embodiment, as shown in FIGS. 6A to 6C, and 7, the developer container 38 includes a long cylindrical container body 200 with both ends being open. The container body 200 is formed by stretch blow molding with synthetic resin of, for example, ABS or PET. An agitator 210 serving as a stirring member that is capable of stirring the housed developer is arranged in the container body 200. End flanges 201 and 202 are mounted on both ends of the cylindrical container body 200.

Figure 8A:
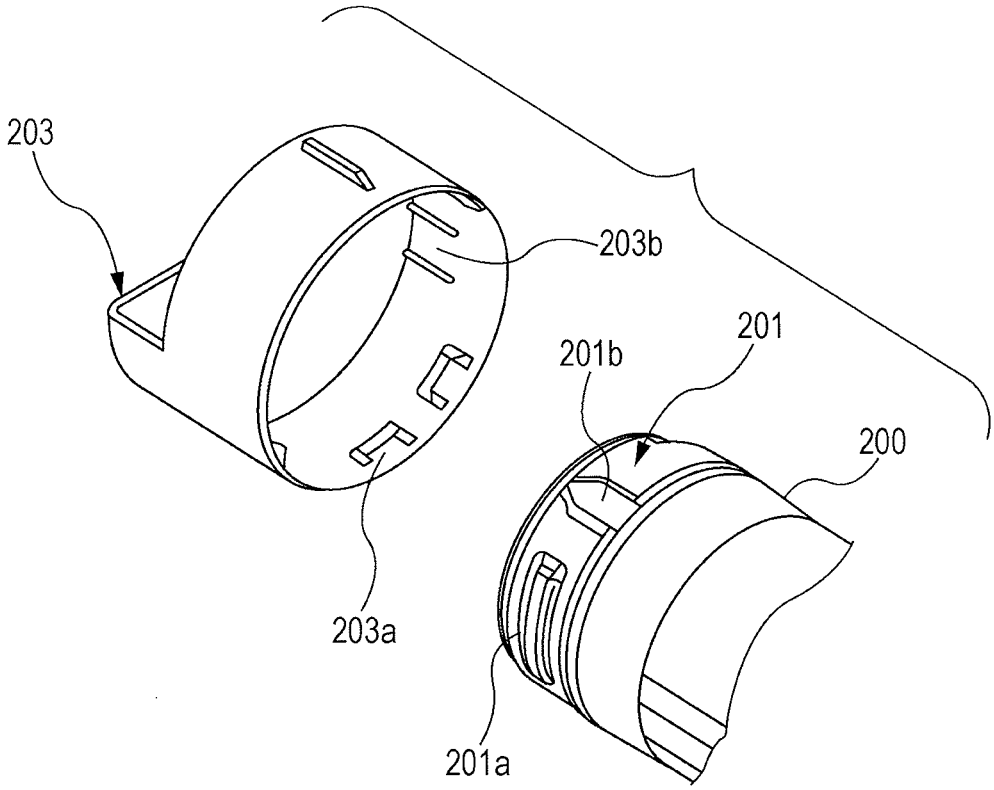
FIGS. 8A and 8B are explanatory views showing the detail of areas near both ends of the developer container.

One end flange 201 is provided with a handle 203 for grasping. As shown in FIG. 8A, the handle 203 is fitted and mounted to one end flange 201. An elastic holding piece 203*a* for preventing falling off is hooked to and held by a step portion 201*a* of the end flange 201. Also, a positioning portion 201*b* of the end flange 201 is fitted to a recessed portion 203*b* for inhibiting rotation, and hence the handle 203 is positioned.

Figure 7:
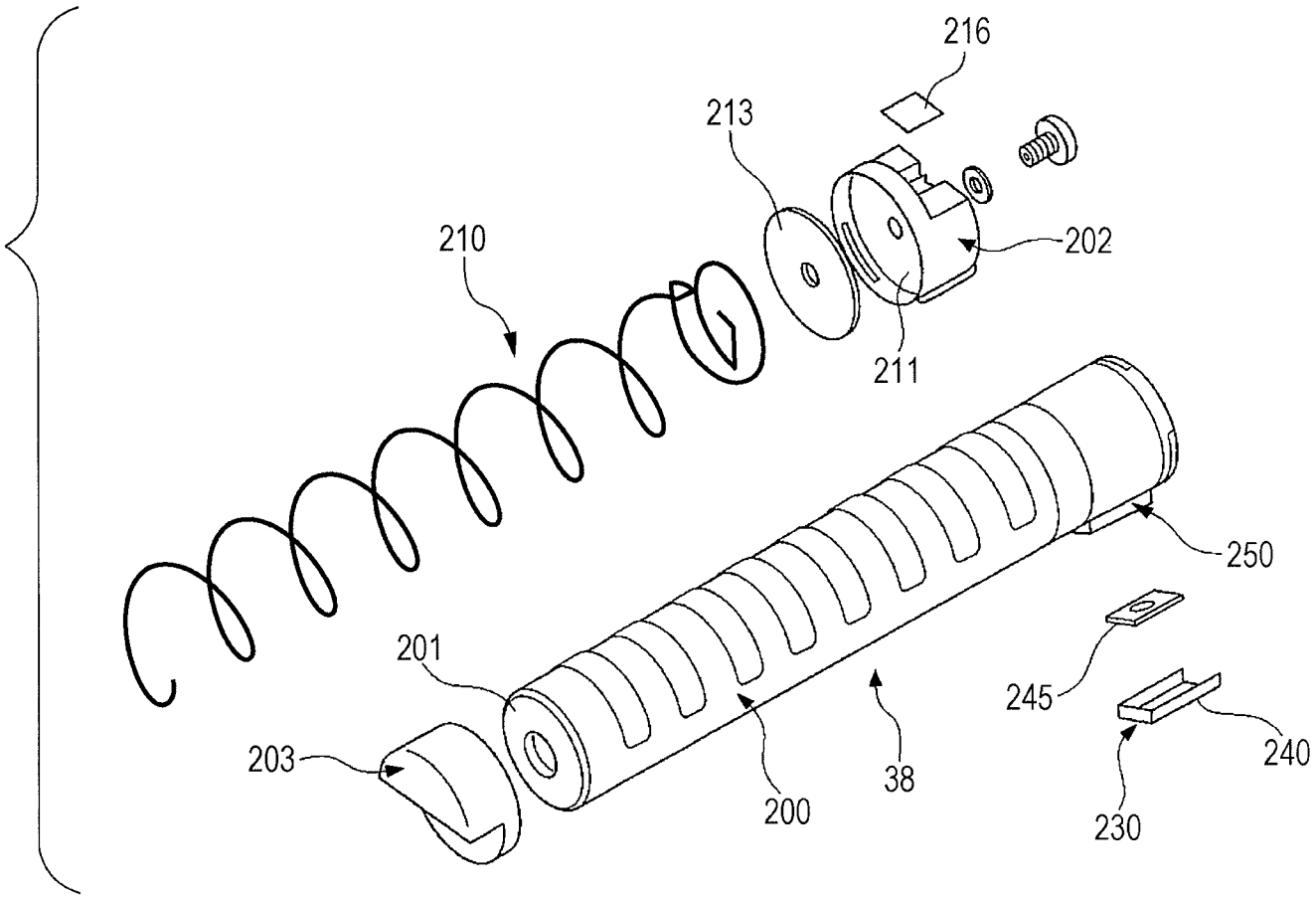
FIG. 7 is an exploded perspective view showing the developer container shown in FIGS. 6A to 6C.
Figure 9A:
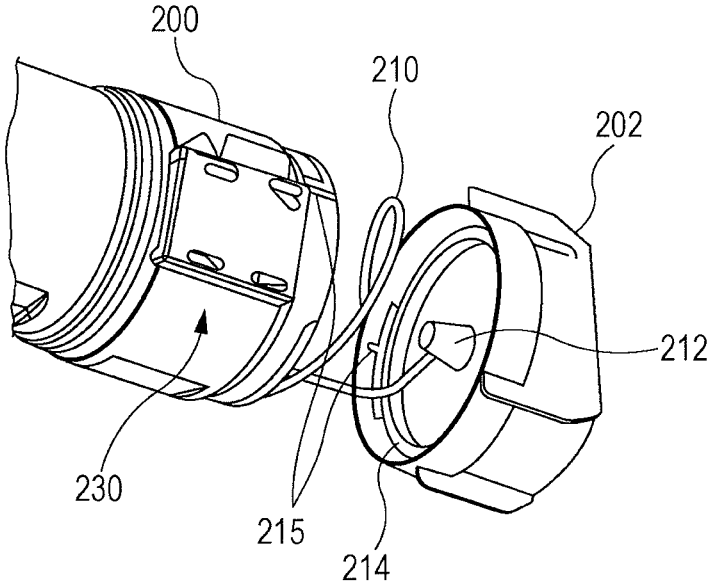
FIG. 9A is an explanatory view showing a state in which one of end flanges of the developer container is detached.
Figure 9B:
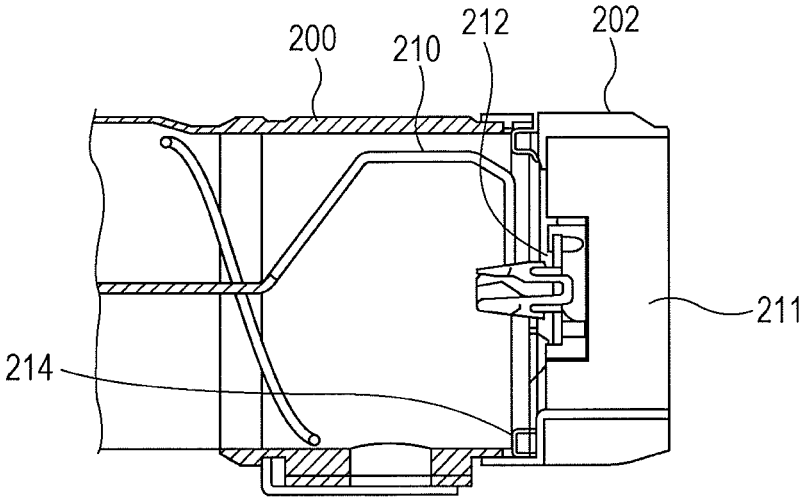
FIG. 9B is an explanatory view showing an example of an attachment structure to the end flange of an agitator.

Also, as shown in FIG. 7 and FIGS. 9A and 9B, the other end flange 202 is provided with a rotor 211 to which a drive shaft extending from an external drive source (not shown) is coupled. A hook portion 212, to which a shaft portion of the agitator 210 is hooked to be supported by the hook portion 212, is provided at a center portion of an inner surface of the rotor 211. A sealing member 213 is provided between the end flange 202 and the container body 200. Also, a ring-shaped sealing member 214 is provided between the rotor 211 and the end flange 202. Also, reference numeral 215 denotes a rotation stopper by fitting of a protrusion with a groove provided between the other end flange 202 and the container body 200.

Figure 8B:
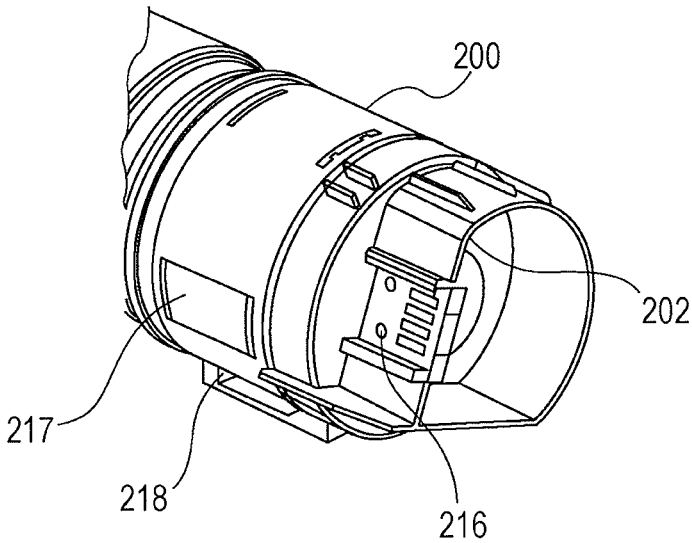

Further, in this exemplary embodiment, as shown in FIG. 8B, a customer replaceable unit memory (CRUM) 216 serving as a use history management memory is mounted on the other end flange 202. When the CRUM 216 is mounted on the container body 200, the CRUM 216 is connected with a control device (not shown) in a manner available for communication. The use history of the developer container 38 is recorded in the CRUM 216. Reference numeral 217 denotes a holding surface of the container body 200 used for assembly or filling with the developer. Reference numeral 218 denotes a rotation stopper used for attachment of the end flange 202.

Shutter

Figure 6A:
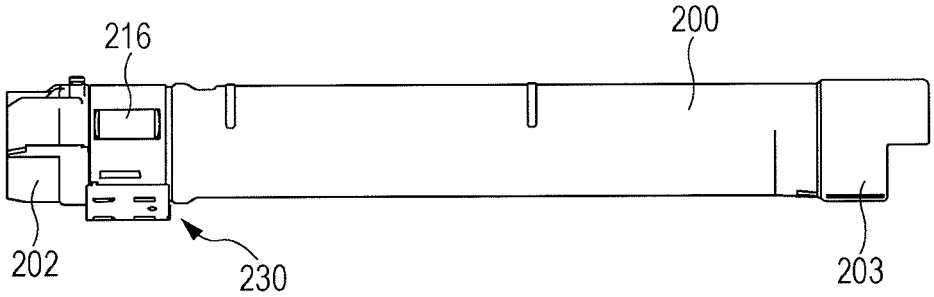
FIG. 6A is an explanatory view showing an entire configuration of the developer container used in the first exemplary embodiment.
Figure 6B:
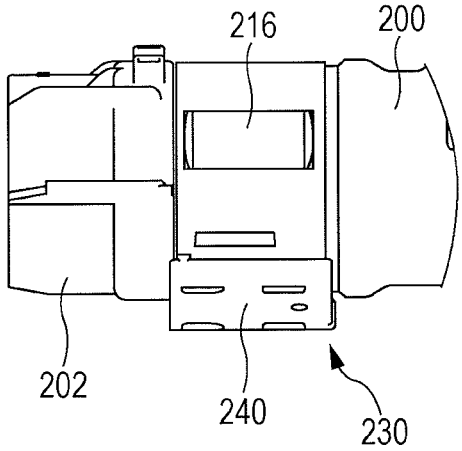
FIG. 6B is an explanatory view when a shutter is closed.
Figure 6C:
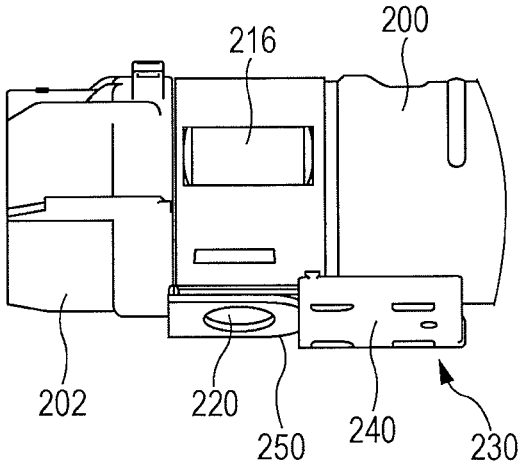
FIG. 6C is an explanatory view when the shutter is open.

In this exemplary embodiment, as shown in FIGS. 6A to 6C, a discharge opening 220 is formed in a peripheral wall of the cylindrical container body 200 at a position near one end in the longitudinal direction. A shutter 230 is provided at the discharge opening 220. The shutter 230 serves as an open/close mechanism that opens and closes the opening 220.

In this exemplary embodiment, as shown in FIGS. 10, and 11A to 11C, the shutter 230 includes an open/close lid 240 that closes the discharge opening 220, and a lid holding frame 250 that holds the open/close lid 240 movably in an open/close operation direction. It is to be noted that an exemplary embodiment having a basic configuration (configuration before a sealing member 430, which will be described later, is added) of the shutter 230 is described below with reference to the drawings until FIG. 27B.

Open/Close Lid

The open/close lid 240 includes a substantially rectangular flat-plate lid body 241 having an area that is at least larger than the discharge opening 220. Side walls 242 are formed at three sides of the lid body 241 excluding one direction in the open/close operation direction. A proper number of holding arms 243 (in this exemplary embodiment, two each with a gap therebetween in the open/close operation direction) that hold the lid holding frame 250 are formed on the side walls 242 located at both sides in a width direction intersecting with the open/close operation direction such that the holding arms 243 inwardly protrude from the side walls 242. Further, a hook pawl 244 serving as a protrusion is formed at an open end of the side wall 242 located at one side in the width direction of the lid body 241. An auxiliary protrusion 248 is formed at a corner at a deep side apart from the open end of the side wall 242 located at the other side in the width direction of the lid body 241. The auxiliary protrusion 248 protrudes toward the lid holding frame 250.

Figure 12:
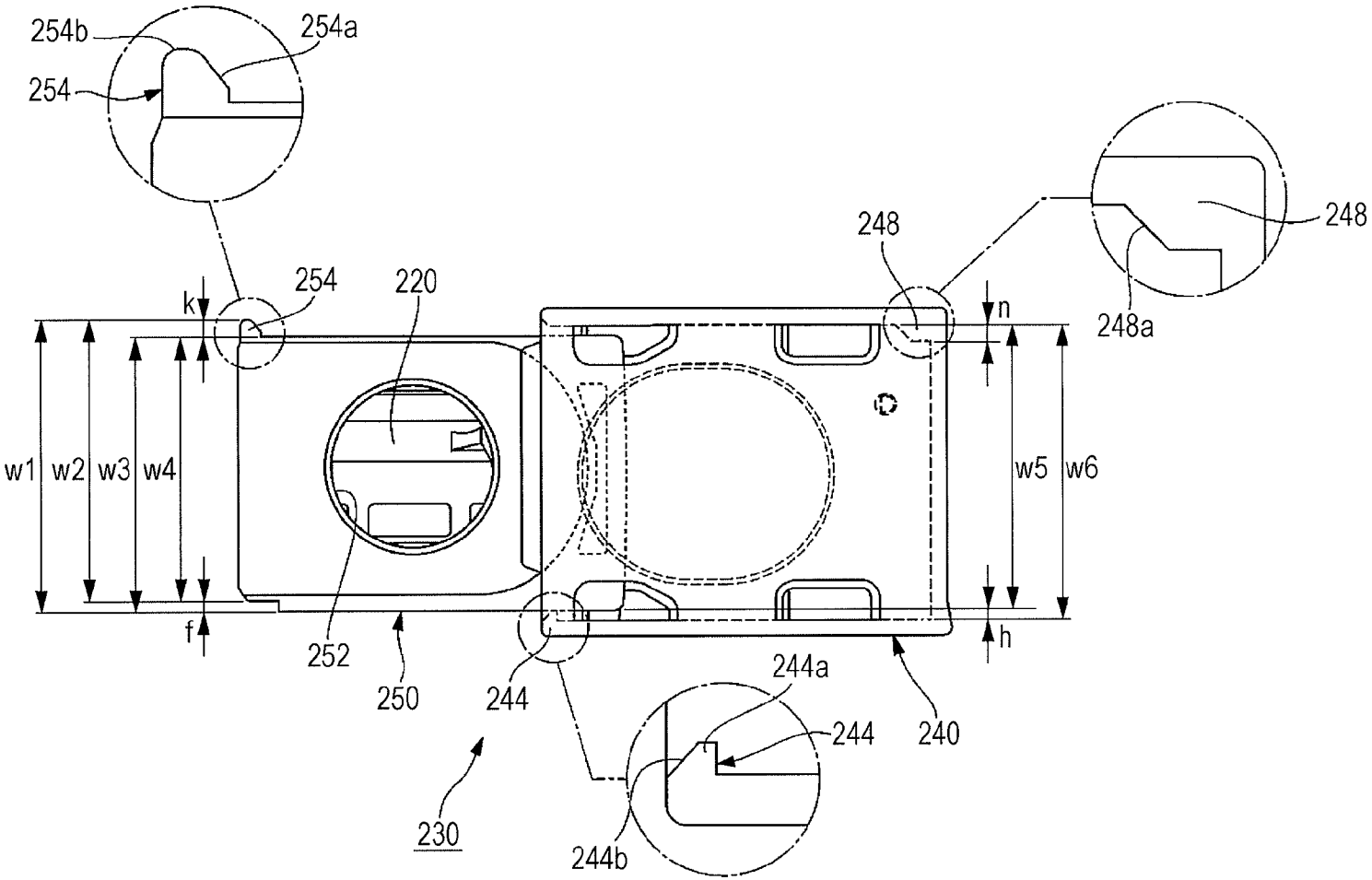
FIG. 12 is an explanatory view showing the detail of the dimensional relationship for an open/close operation of the shutter (open/close lid, lid holding frame) used in the first exemplary embodiment.

Particularly in this exemplary embodiment, as shown in FIG. 12, the hook pawl 244 includes a claw-like pawl 244*a* and a tapered portion 244*b* that is provided at the claw-like pawl 244*a* and is tapered toward a hook end. The hook pawl 244 has a structure such that the hook end of the claw-like pawl 244*a* is easily elastically deformed.

As shown in FIG. 12, the auxiliary protrusion 248 has a trapezoidal cross section including a guide tapered portion 248*a* at the open end side of the open/close lid 240 other than the three side walls 242. The guide tapered portion 248*a* is inclined so as to protrude toward the lid holding frame 250 in the open/close operation direction of the open/close lid 240 and to be tapered outward.

In this exemplary embodiment, an elastic sealing member 245 (see FIG. 7), which is an example of a close-contact member that elastically contacts a surface of the lid holding frame 250, is, for example, bonded to a side surface of the lid holding frame 250 of the lid body 241. Also, holes 246 are formed in portions of the lid body 241 corresponding to the holding arm 243. The open/close lid 240 holds each of both side edges of the lid holding frame 250 by the two holding arms 243 and the lid body 241 located between the holding arms 243, so that the open/close lid 240 stably moves along both side edges of the lid holding frame 250.

A dimension j between the holding arm 243 and the lid body 241 of the open/close lid 240 is determined with play as compared with a thickness of the side edge of the lid holding frame 250.

Figure 10:
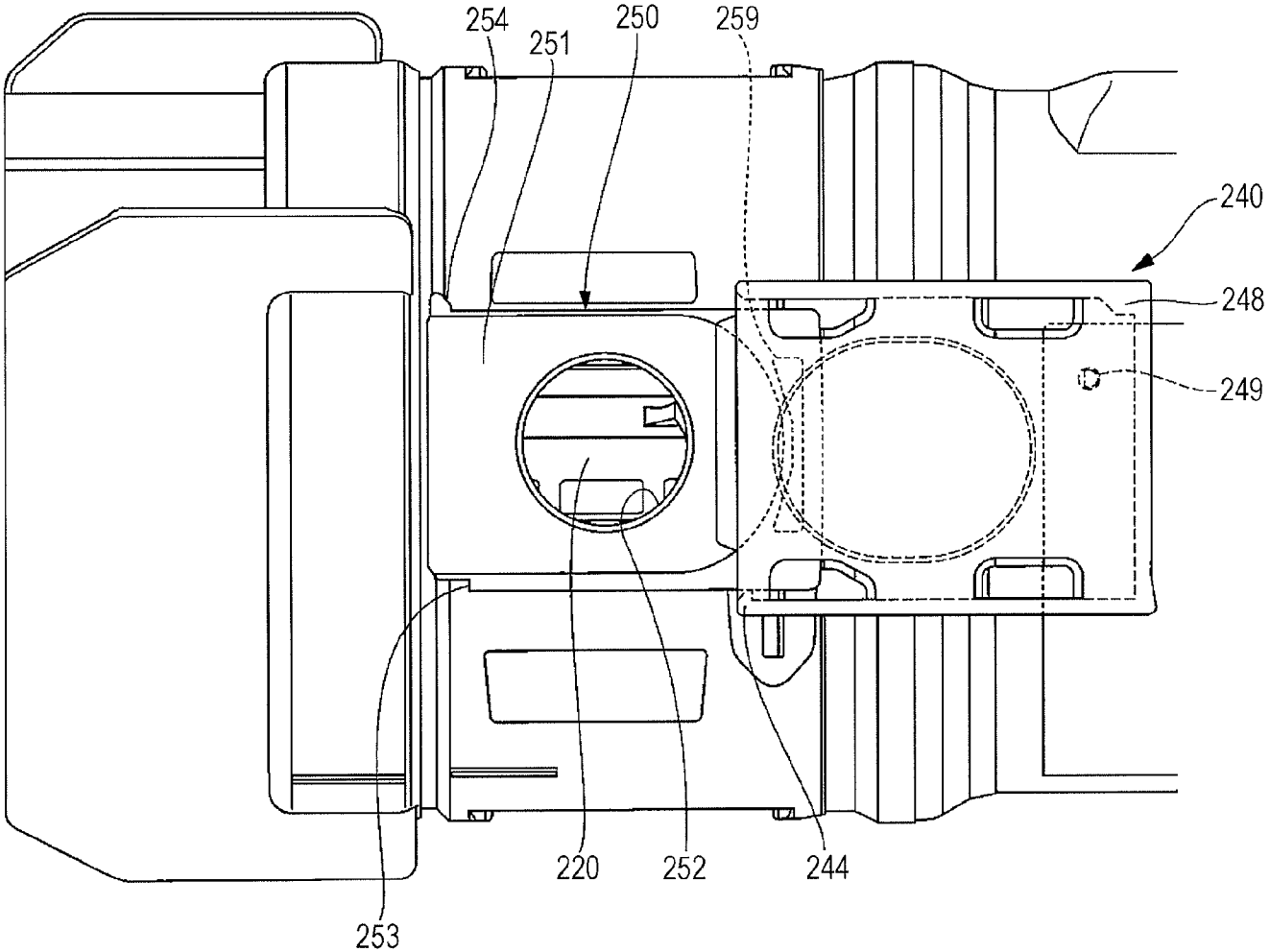
FIG. 10 is an explanatory view showing the detail of a basic configuration (configuration before a sealing member is added) of a shutter (open/close lid, lid holding frame) as an open/close mechanism used in the first exemplary embodiment, the shutter illustrated in any of FIGS. 11A to 27B representing an exemplary embodiment with the basic configuration before the sealing member is added.
Figure 11A:
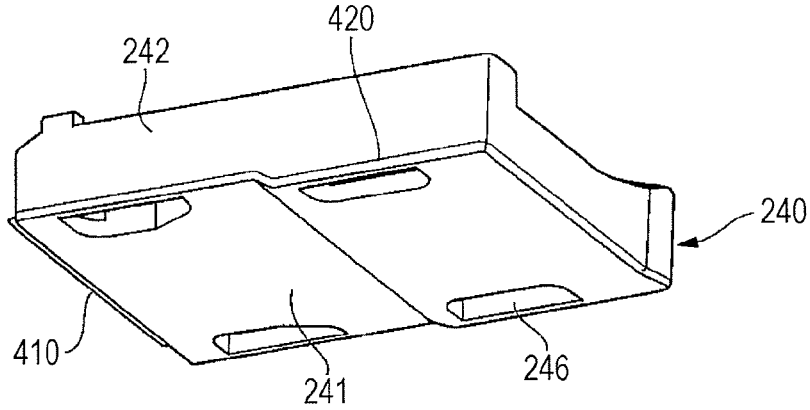
FIG. 11A is a perspective view of the open/close lid of the shutter used in the first exemplary embodiment when viewed from the outside.
Figure 11B:
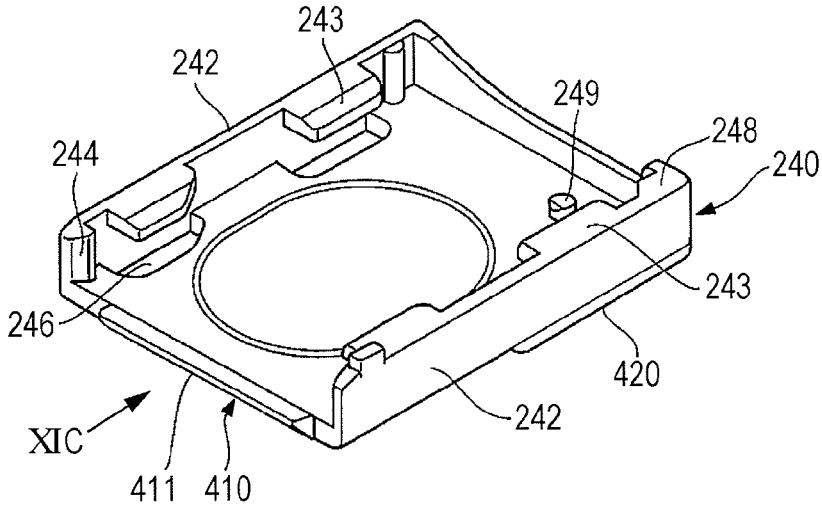
FIG. 11B is a perspective view showing the inside of the open/close lid in FIG. 11A.
Figure 11C:
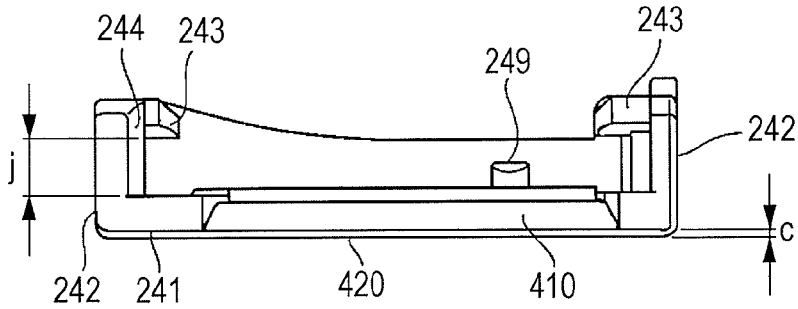
FIG. 11C is a view from arrow XIC in FIG. 11B.

In FIG. 11B, reference numeral 249 is a stopper protrusion that protrudes from a portion of the back surface of the lid body 241 of the open/close lid 240. For example, if the lid body 241 of the open/close lid 240 is deformed in a crushed manner by an external force, the stopper protrusion 249 is fitted into a stopper groove 259 (see FIG. 10) formed in the lid holding frame 250, and prevents the open/close lid 240 from being unnecessarily opened.

Further, in this exemplary embodiment, the lid body 241 has a restricting piece 410 having a triangular cross section, as an example of a first restricting portion, at the open end other than the three side walls 242 of the open/close lid 240. This restricting piece 410 includes an inclined surface 411 that is inclined to gradually protrude from an outer surface to an inner surface of the lid body 241.

Also, the lid body 241 has an extending portion 420, which is an example of a second restricting portion, at a portion of the outer surface apart from the restricting piece 410. The extending portion 420 extends by a step c from the residual outer surface. The extending portion 420 restricts a posture of the open/close lid 240 with respect to a support surface of the container receiver 100 such that the restricting piece 410 of the open/close lid 240 is inclined forward and tilted down.

Lid Holding Frame

In this exemplary embodiment, as shown in FIG. 10, the lid holding frame 250 includes a substantially rectangular flat plate frame body 251, a through hole 252 made in the frame body 251 at a portion corresponding to the discharge opening 220, a notch-like engagement portion 253 formed at one of corners of an edge of the frame body 251 located in a direction in which the open/close lid 240 is closed, and a restricting protrusion 254 formed at another corner of the edge of the frame body 251 located in the direction in which the open/close lid 240 is closed.

Also, in this exemplary embodiment, a dimension between both edges in the width direction of the lid holding frame 250 is determined to be slightly smaller than a dimension between the side walls 242 arranged at both sides in the width direction of the open/close lid 240.

Further, in this exemplary embodiment, as shown in FIGS. 10 to 12, a protruding length k of the restricting protrusion 254 from a reference position of both edges in the width direction of the lid holding frame 250 is determined to be larger than a dimension in the width direction of the engagement portion 253. If the side wall 242 in the width direction of the open/close lid 240 contacts the reference position of both edges in the width direction of the lid holding frame 250, the open/close lid 240 moves in the width direction by the protruding length k of the restricting protrusion 254. Hence, the hook pawl 244 of the open/close lid 240 no longer contacts the engagement portion 253, and the positional relationship in which restraint is released is maintained.

Particularly in this exemplary embodiment, as shown in FIG. 12, the restricting protrusion 254 is arranged at the distal end side of the lid holding frame 250 as compared with the hooked surface of the engagement portion 253 to the hook pawl 244 in the open/close operation direction of the open/close lid 240. The restricting protrusion 254 has a guide tapered portion 254*a* that guides the open/close lid 240 in a direction intersecting with the open/close operation direction when a distal end of one of the side walls 242 of the open/close lid 240 contacts the restricting protrusion 254. The restricting protrusion 254 also has a curved portion 254*b* extending from the guide tapered portion 254*a* to the top so as to reduce frictional resistance with respect to an inner surface of the side wall 242 of the open/close lid 240.

Regarding dimensional relationship for the open/close operation of the shutter 230 (open/close lid 240, lid holding frame 250), the dimensional relationship is as shown in FIG. 12.

Referring to FIG. 12, w1 to w6, and f, h, k, and n indicate dimensions as follows:

w1 is a maximum width of the lid holding frame from the side wall without the restricting protrusion to the distal end of the restricting protrusion;

w2 is a width of the lid holding frame from the distal end of the restricting protrusion to a position in front of the engagement portion;

w3 is a width of the lid holding frame between both side portions excluding the restricting protrusion;

w4 is a width of the lid holding frame from one of the side walls to a position in front of the engagement portion excluding the restricting protrusion;

w5 is a width of the open/close lid from an inner wall of one of the side walls in the width direction to a position in front of the hook pawl;

w6 is a maximum width of the open/close lid between side walls arranged at both sides in the width direction including a hook length of the hook pawl;

f is an engagement length of the engagement portion;

h is a hook length of the stopper portion (hook pawl);

k is a protruding length of the restricting protrusion; and n is a protruding length of the auxiliary protrusion.

In FIG. 12, considering a condition that the open/close lid 240 is fitted to the lid holding frame 250, if w2>w5 and w3>w5, the open/close lid 240 is not fitted to the lid holding frame 250, and hence (w5−w2)>0 and (w5−w3)>0 have to be satisfied.

Next, if w1<w5, the hook pawl 244 and the engagement portion 253 do not overlap with each other in the open/close direction even if the open/close lid 240 moves along the distal end position of the restricting protrusion 254, and hence the hook pawl 244 and the engagement portion 253 may not function as a movement restraining member. Therefore, (w1−w5)>0 has to be satisfied.

Considering the stop length f (w1−w2) of the engagement portion 253, f has to be larger than the gap of w5−w2, i.e., {f−(w5−w2)}>0 or f>(w5−w2) has to be satisfied.

Similarly, considering the protruding length k (w1−w3) of the restricting protrusion 254, k has to be larger than the gap of w5−w3, i.e., {k−(w5−w3)}>0 or k>(w5−w3) has to be satisfied.

Further, if the hook length h (w6−w5) of the hook pawl 244 is small, this results in w1>w6 and fitting is not provided, and hence (w6−w1)>0 has to be satisfied.

At this time, h has to be larger than the gap of w6−w1, i.e., {h−(w6−w1)}>0 or h>(w6−w1) has to be satisfied.

Shutter Operation Process

In this exemplary embodiment, the shutter 230 undergoes operation processes shown in FIGS. 13A to 16B.

Figure 13A:
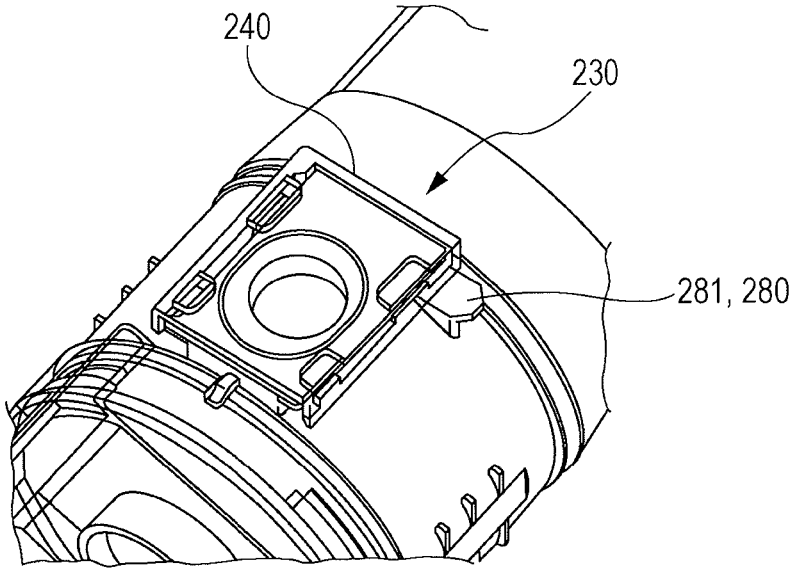
FIG. 13A is a perspective view showing a state in which the open/close lid of the shutter is located at a close position.
Figure 13B:
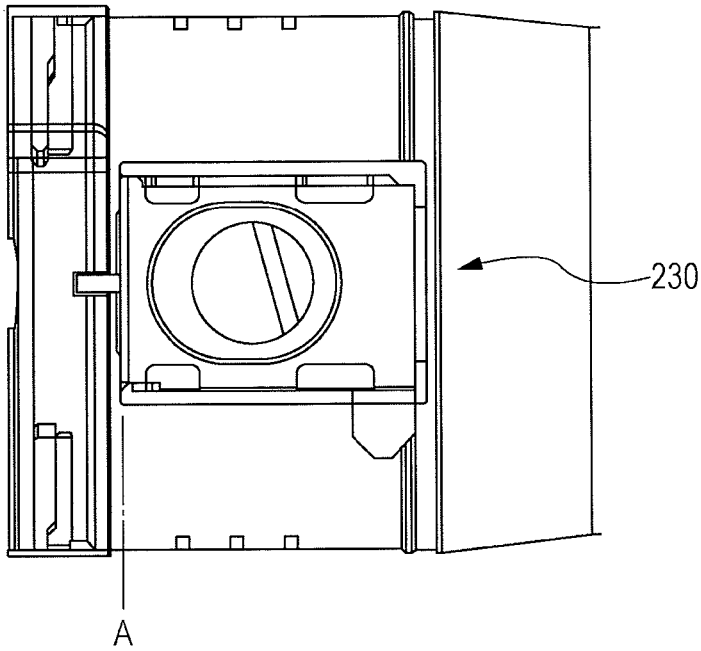
FIG. 13B is an explanatory plan view of this state.

(1) Shutter Close (FIGS. 13A and 13B)

This is a state in which the open/close lid 240 is located at a close position A at which the discharge opening 220 is completely closed.

Figure 17B:
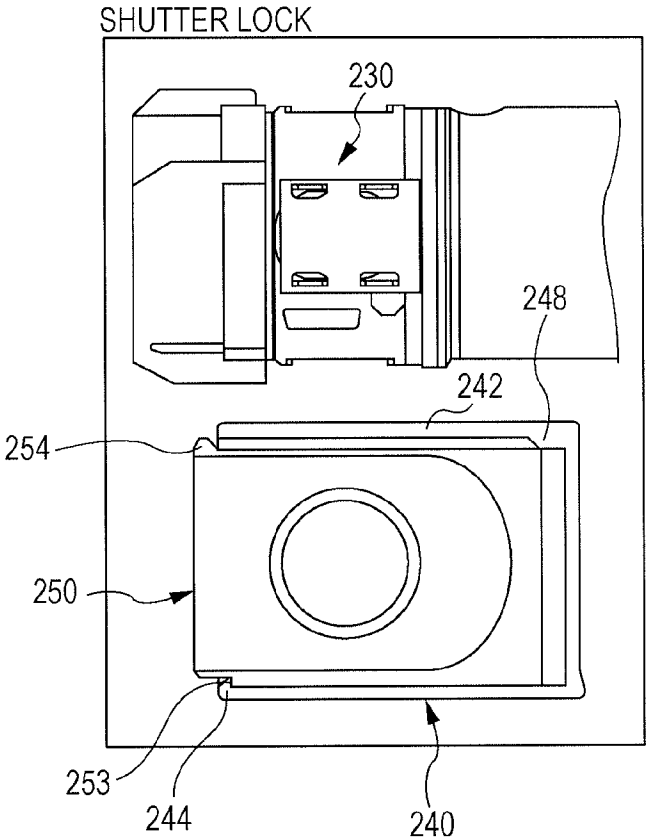
FIG. 17B is an explanatory view showing an operation process of the shutter when the open/close lid is locked.
Figure 17A:
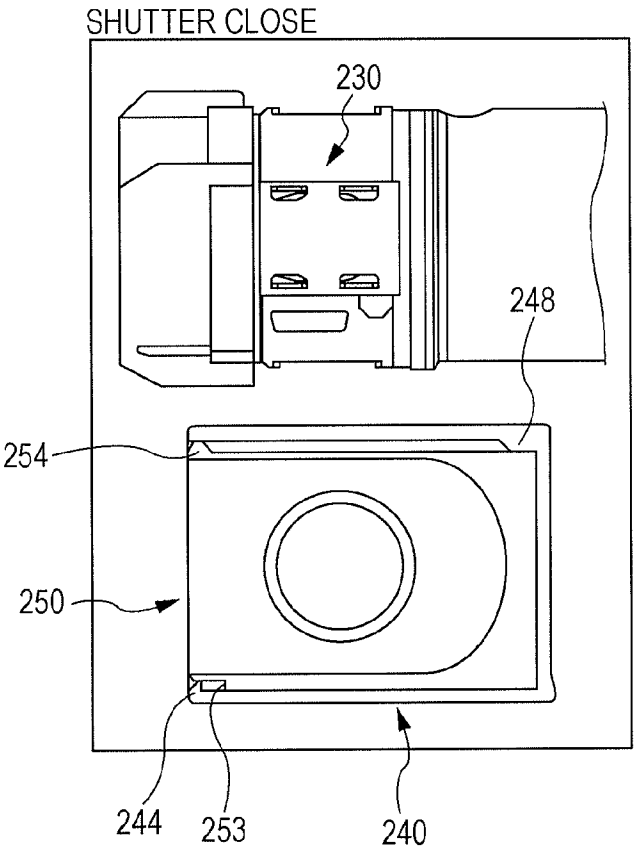
FIG. 17A is an explanatory view showing an operation process of the shutter when the open/close lid is located at the close position.

At this time, as shown in FIG. 17A, the side wall 242 located in the open/close operation direction of the open/close lid 240 contacts one end in the open/close operation direction of the lid holding frame 250. The side wall 242 in the width direction of the open/close lid 240 is located at the position at which the side wall 242 contacts the distal end of the restricting protrusion 254 of the lid holding frame 250.

Particularly in this exemplary embodiment, since the auxiliary protrusion 248 of the open/close lid 240 contacts the lid holding frame 250, the posture of the open/close lid 240 at the close position A is maintained straight along the open/close operation direction.

Figure 14A:
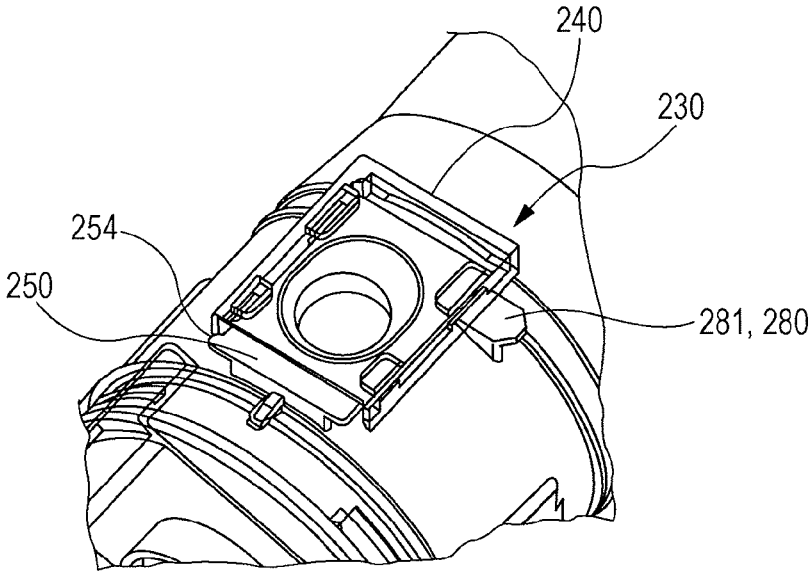
FIG. 14A is a perspective view showing a lock state in which the open/close lid of the shutter is located in front of a position at which the open/close lid is started to be opened.
Figure 14B:
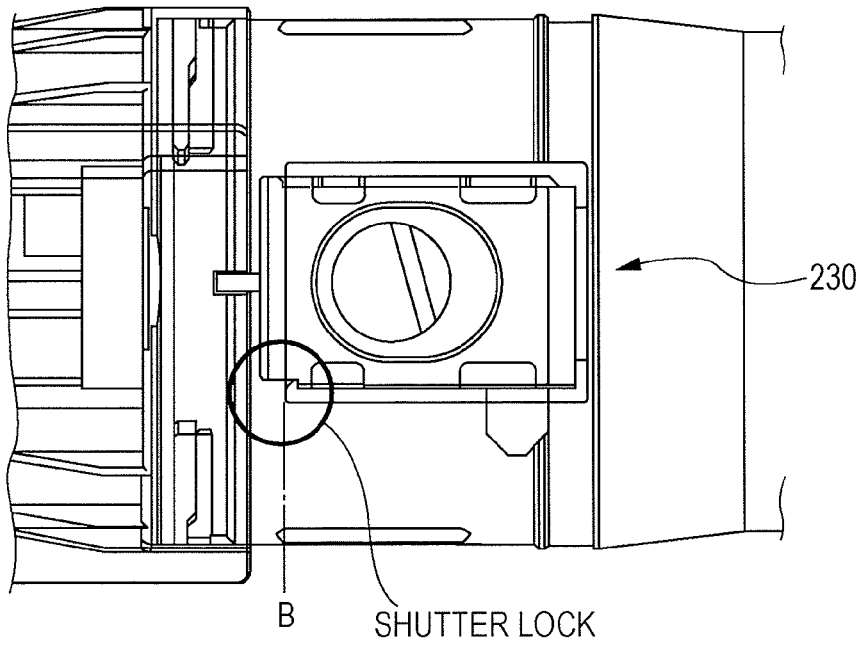
FIG. 14B is an explanatory plan view of this state.

(2) Shutter Lock (FIGS. 14A and 14B)

When the open/close lid 240 moves in an opening direction from the state shown in FIGS. 13A and 13B, as shown in FIGS. 14A and 14B, the open/close lid 240 moves while the state in which the position of the open/close lid 240 is restricted by the restricting protrusion 254 is maintained, and the hook pawl 244 of the open/close lid 240 contacts the engagement portion 253 (see FIG. 17B).

At this time, the movement of the open/close lid 240 is restrained at a position B in front of a position at which the open/close lid 240 is started to be opened, and hence the shutter 230 is locked in the open/close operation direction.

Accordingly, for example, even if the developer container 38 is unintentionally dropped during attachment, or if a cushioning material such as a styrofoam material is not stuffed in both side spaces of the developer container 38 during transportation, the shutter 230 is hardly accidentally opened.

Figure 15A:
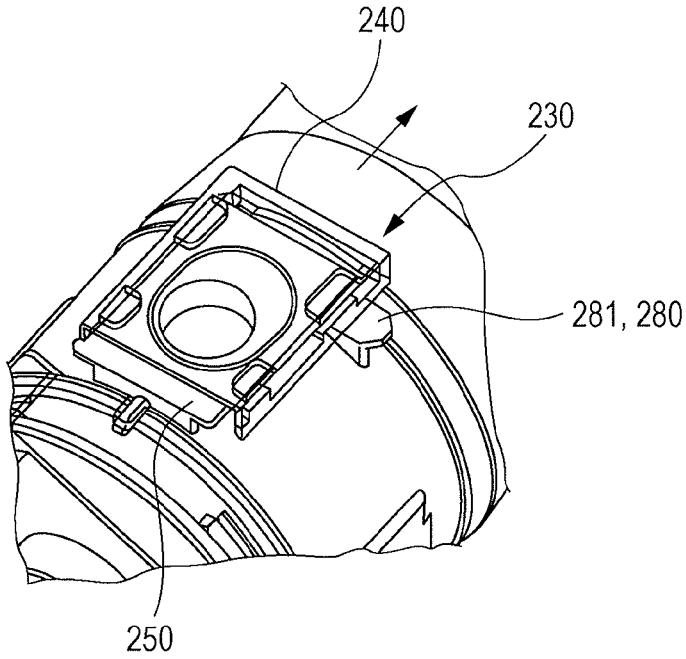
FIG. 15A is a perspective view showing a state in which the open/close lid of the shutter is unlocked.
Figure 15B:
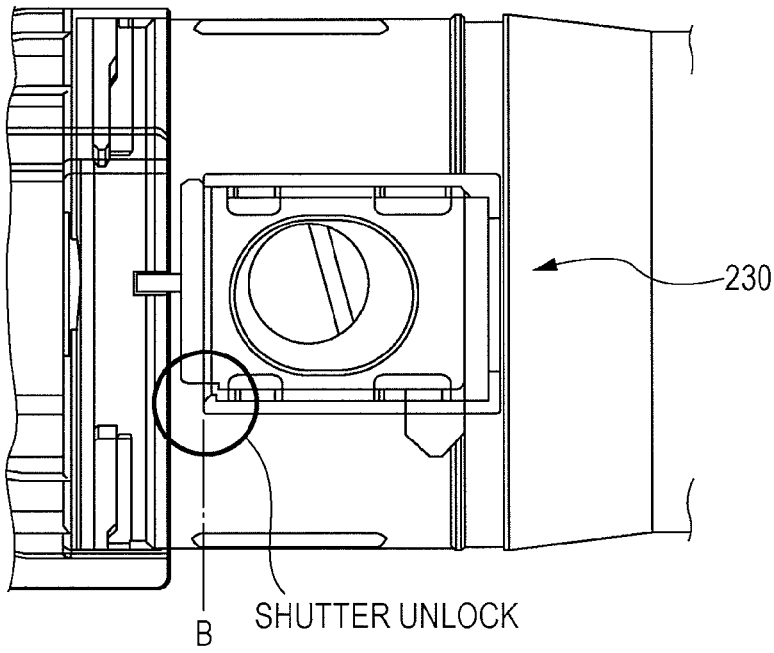
FIG. 15B is an explanatory plan view of this state.

(3) Shutter Unlock (FIGS. 15A and 15B)

As described in (2), in the shutter lock state, the side wall 242 in the width direction of the open/close lid 240 moves to a position beyond the restricting protrusion 254 of the lid holding frame 250. Accordingly, the open/close lid 240 is allowed to move in the direction intersecting with the open/close operation direction toward the edges in the width direction of the lid holding frame 250.

Figure 18B:
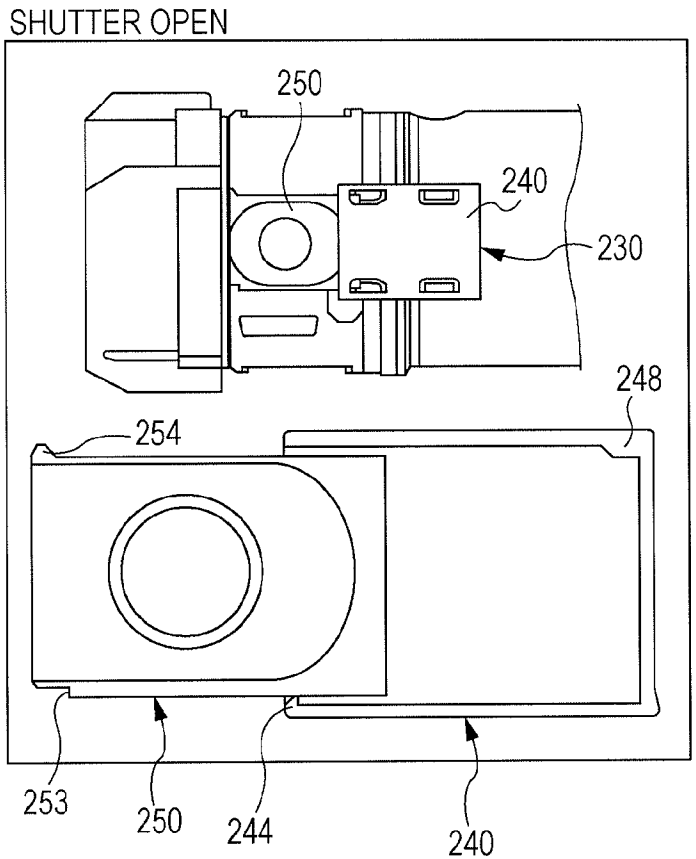
FIG. 18B is an explanatory view showing an operation process of the shutter when the open/close lid is located at the open position.
Figure 18A:
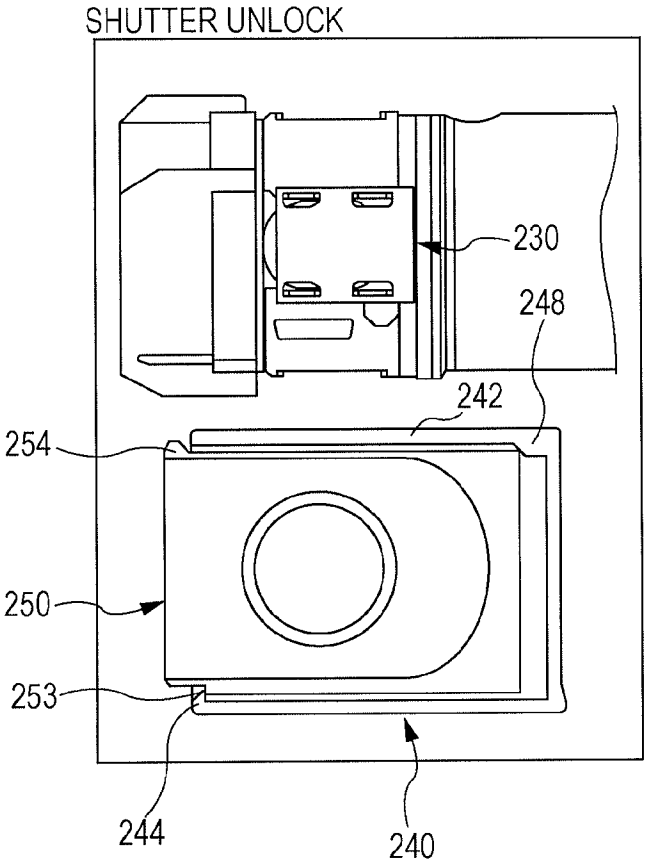
FIG. 18A is an explanatory view showing an operation process of the shutter when the open/close lid is unlocked.

At this time, as shown in FIG. 18A, the hook pawl 244 of the open/close lid 240 moves from a position at which the hook pawl 244 is deeply hooked to the engagement portion 253 of the lid holding frame 250, to a position at which the hook pawl 244 is lightly hooked to the engagement portion 253. Hence, in this state, the hook pawl 244 is allowed to be disengaged from the engagement portion 253 by elastic deformation of the hook pawl 244. Accordingly, the open/close lid 240 becomes movable relative to the open position in the open/close operation direction. The restraint state of the open/close lid 240 by the engagement portion 253 and the hook pawl 244 is released. That is, the shutter 230 that is locked in the open/close operation direction is unlocked, and becomes movable in the open/close operation direction.

Figure 16A:
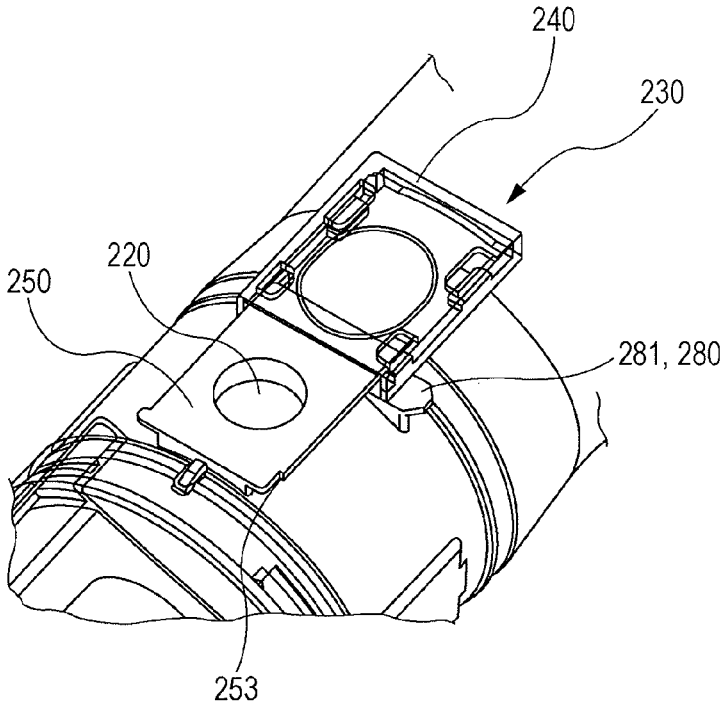
FIG. 16A is a perspective view showing a state in which the open/close lid of the shutter is located at an open position.
Figure 16B:
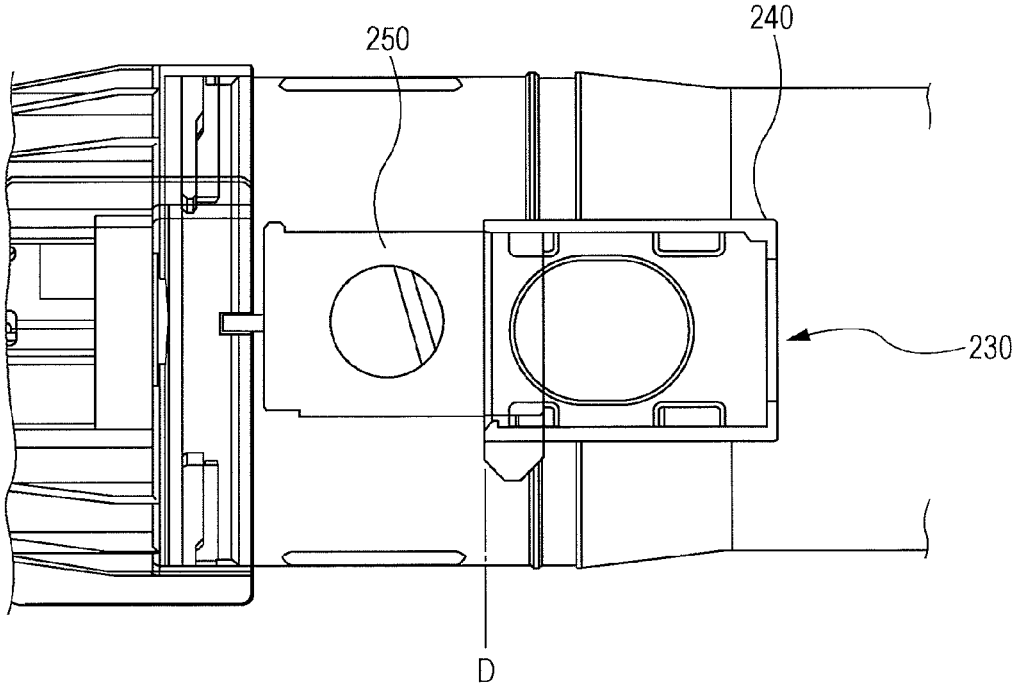
FIG. 16B is an explanatory plan view of this state.

(4) Shutter Open (FIGS. 16A and 16B)

As written in (3), if the shutter 230 is unlocked, the movement of the open/close lid 240 in the open/close operation direction is allowed. Hence, the open/close lid 240 moves to an open position D and completely opens the discharge opening 220 as shown in FIGS. 16*a* and 16*b*.

At this time, as shown in FIG. 18B, the hook pawl 244 of the open/close lid 240 moves while the hook pawl 244 elastically contacts the edge in the width direction of the lid holding frame 250. Hence, the open/close lid 240 moves to an end position (open position D) without the open operation of the open/close lid 240 being disturbed.

In this state, in this exemplary embodiment, since an urging force does not have to be applied by, for example, a spring, to the open/close lid 240 and the lid holding frame 250, the open/close lid 240 moves in the open/close operation direction without necessity of a large operation force.

For example, in a comparative exemplary embodiment in which an open/close lid is elastically held by a lid holding frame using an urging force of, for example, a spring, sliding resistance due to the spring urging force acts on the open/close lid and the lid holding frame. Hence, the operation force in the open/close operation direction is required by a certain degree.

In a comparative exemplary embodiment without a member for restraining the movement, to properly maintain the closing performance by the open/close mechanism when a dropping accident occurs or an impact is applied during transportation, the movement of the open/close lid has to be intentionally interrupted, for example, by increasing the thickness of the elastic sealing member, to prevent the open/close lid from moving because of the impact of the drop. Owing to this, the open/close lid is resistant to the impact of the drop; however, the operation force in the open/close operation direction increases.

Container Receiver

In this exemplary embodiment, the container receiver 100 includes a function portion that performs the open/close operation of the shutter 230 through the above-described shutter lock and shutter unlock when the developer container 38 is inserted and removed.

Figure 19:
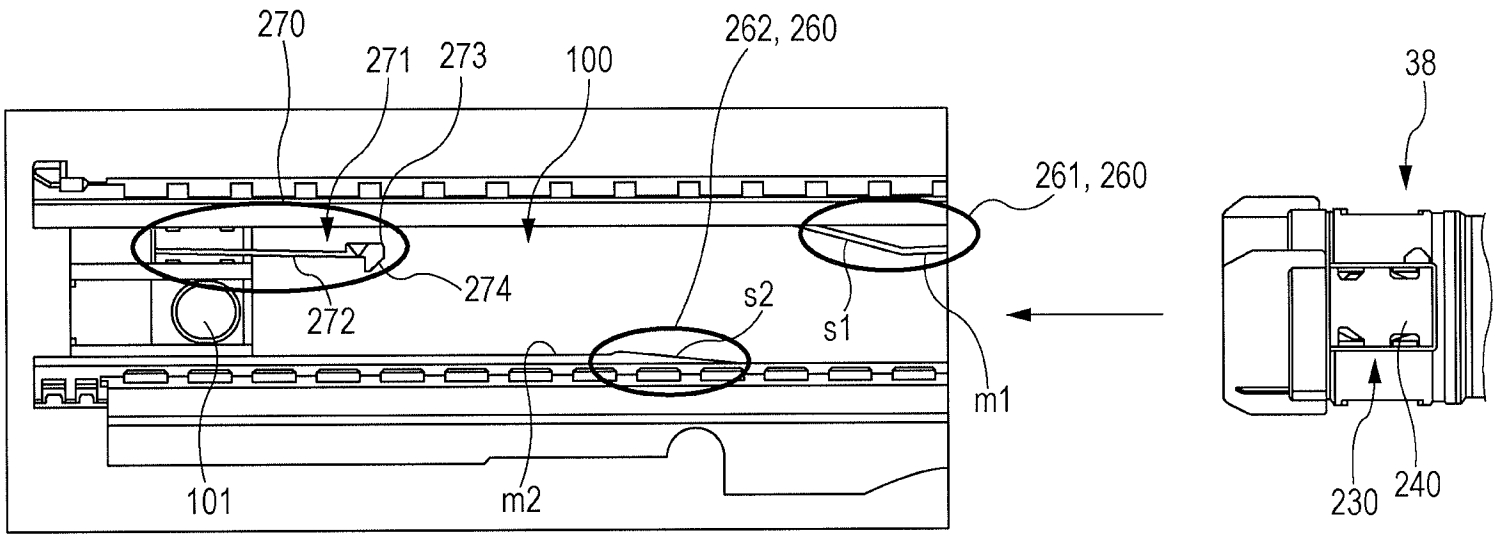
FIG. 19 is an explanatory view showing the detail of a container receiver used in the first exemplary embodiment.

In this exemplary embodiment, as shown in FIG. 19, the container receiver 100 includes a lid guide rail 260, a lid movably holding mechanism 270, and a lid releasing mechanism 280 (see FIGS. 13A and 13B). The lid guide rail 260 guides the moving path of the open/close lid 240 of the developer container 38. The lid movably holding mechanism 270 contacts the open/close lid 240, moves the open/close lid 240 toward the open position D, and then holds the open/close lid 240 when the insertion of the developer container 38 is completed, and also moves the open/close lid 240 at the open position D toward the close position A when the developer container 38 is removed. The lid releasing mechanism 280 releases the holding state of the open/close lid 240 by the lid movably holding mechanism 270 when the developer container 38 is removed and when the open/close lid 240 has reached the close position A. In FIG. 19, reference numeral 101 is a through hole communicating with the reserve tank 110. FIG. 19 is a schematic illustration showing the container receiver 100 and the developer container 38 when viewed from the through hole 101 side.

Lid Guide Rail

An example of the lid guide rail 260 includes a first guide surface m1 that restricts the position of the side walls 242 arranged on both sides in the width direction of the open/close lid 240 when the shutter 230 of the container receiver 100 is located at the close position A. The lid guide rail 260 also includes a first lid guide rail 261 that releases the restriction by the first guide surfaces m1 at a middle position; and a second lid guide rail 262 that is provided at the deeper side than the first lid guide rail 261 and shifts to a second guide surface m2 that guides the shutter 230 to move from the lock position to the unlock position.

Particularly in this exemplary embodiment, the first lid guide rail 261 has a guide surface s1 that is inclined to become wide outward from a terminal end of the first guide surface m1. The second lid guide rail 262 has a guide surface s2 that is inclined in substantially the same direction as the guide surface s1 from a position at which the restriction of the open/close lid 240 of the shutter 230 by the first guide surface m1 is completely released. The second lid guide rail 262 shifts to the second guide surface m2 via the guide surface s2.

Lid Movably Holding Mechanism

An example of the lid movably holding mechanism 270 includes an elastic holding piece 271, as an example of an elastically deformable press member that extends in the open/close operation direction of the open/close lid 240. The elastic holding piece 271 includes an elastic plate member 272 that is elastically deformable, and a claw-like holding protrusion 273 that is located at a distal end of the elastic plate member 272 and integrally formed with the elastic plate member 272. A guide portion 274 may be provided at the distal end of the holding protrusion 273 such that the guide portion 274 is elastically deformable outward when the open/close lid 240 contacts the guide portion 274. The elastic holding piece 271 thus configured contacts the open/close lid 240 and moves the open/close lid 240 to the open position D when the developer container 38 is inserted. Also, the elastic holding piece 271 is elastically deformed outward to be separated from the open/ close lid 240 and then holds the open/close lid 240 when the open/close lid 240 has reached the open position D.

Lid Releasing Mechanism

An example of the lid releasing mechanism 280 (see FIGS. 13A and 13B) may include a releasing protruding piece 281 (see FIGS. 22A and 22B) that is elastically deformed in a direction in which the elastic holding piece 271 is separated from the open/close lid 240 when the open/close lid 240 has reached the close position A. The releasing protruding piece 281 releases the holding state of the open/close lid 240 by the elastic holding piece 271.

In this exemplary embodiment, as shown in FIGS. 13A to 16B, the releasing protruding piece 281 is provided at the shutter 230 at a position near the lid holding frame 250, acts on the elastic holding piece 271 of the lid movably holding mechanism 270 when the developer container 38 is removed from the container receiver 100, and releases the holding state of the open/close lid 240 by the elastic holding piece 271.

Insertion and Removal Operation Processes of Developer Container

Next, the insertion operation process and the removal operation process of the developer container are described with reference to FIGS. 19 to 22B. In FIGS. 19 to 22B, the developer container 38 is illustrated in a perspective manner to show the relative positional relationship between the container receiver 100 and the developer container 38.

Figure 20B:
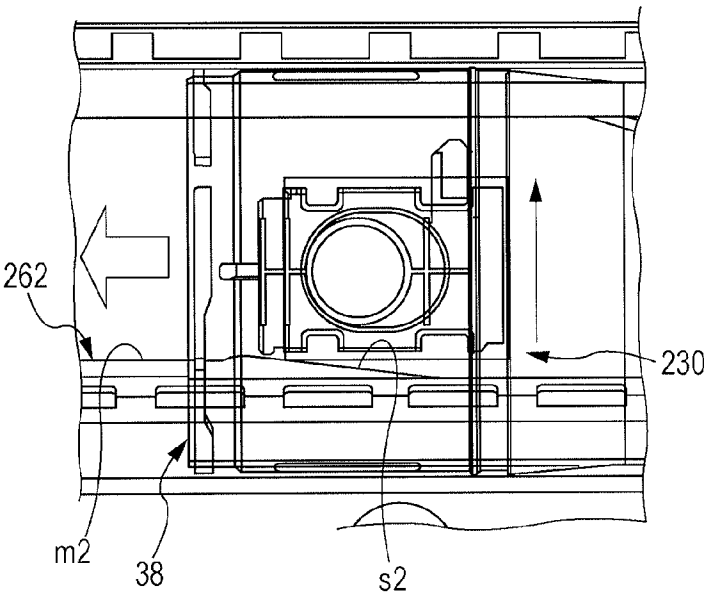
FIGS. 20A and 20B are explanatory views each showing an operation process (1) when the developer container is inserted into the container receiver in the first exemplary embodiment.
Figure 20A:
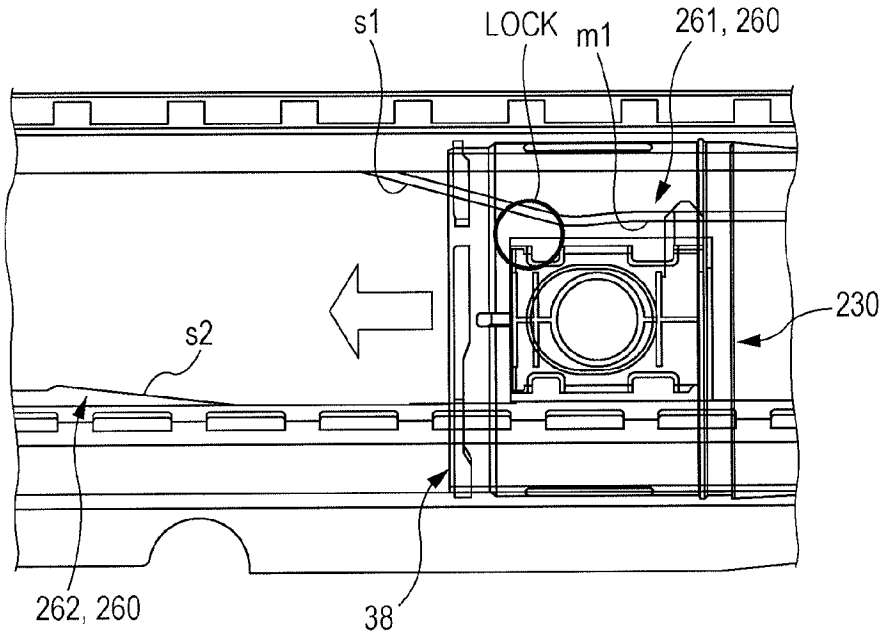

(1) Insertion Operation Process of Developer Container (FIGS. 19, 20A and 20B)

When the developer container 38 is inserted into the container receiver 100, the shutter 230 is operated as follows.

Figure 21B:
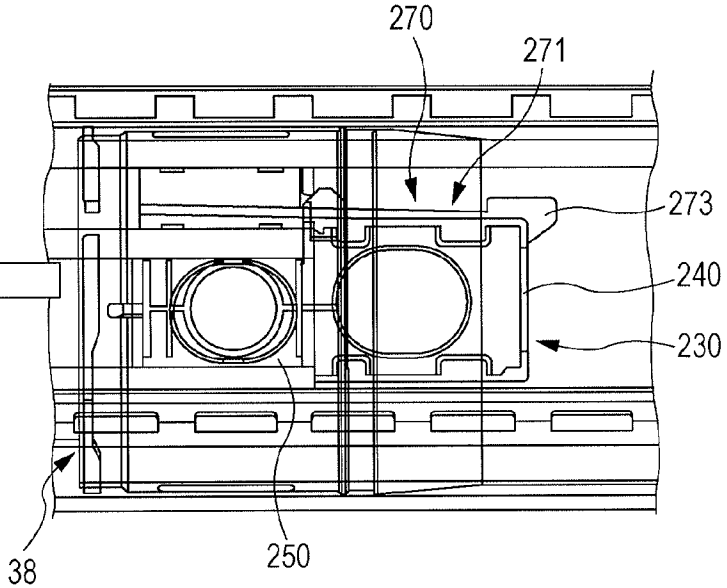
FIGS. 21A and 21B are explanatory views each showing an operation process (2) when the developer container is inserted into the container receiver in the first exemplary embodiment.
Figure 21A:
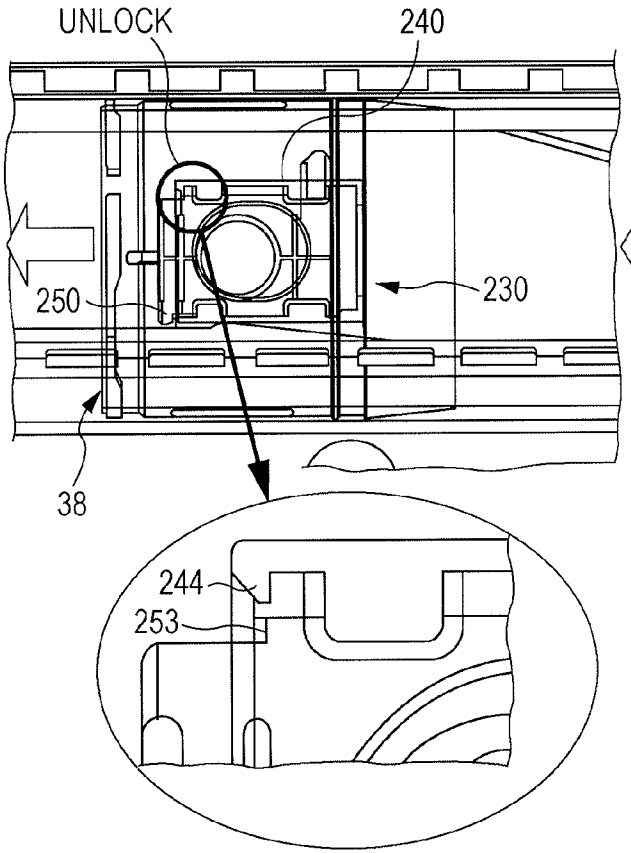

The open/close lid 240 located at the close position A moves while being guided by the lid guide rail 260 (261, 262), and as shown in FIGS. 20A and 20B, and 21A, the state becomes the lock state and then becomes the unlock state when the open/close lid 240 has reached the position B (see FIG. 15B) in front of the position at which the open/close lid 240 is started to be opened. Then as shown in FIGS. 21A and 21B, the open/close lid 240 is moved to the open position D by the elastic holding piece 271 of the lid movably holding mechanism 270, and then the open/close lid 240 is moved while pressing the elastic holding piece 271 outward until the open/close lid 240 is held by the elastic holding piece 271.

Meanwhile, a user may insert the developer container 38 in an insertion/removal operation direction (corresponding to attachment/detachment operation direction) in which the developer container 38 is operated when the user inserts or removes the developer container 38 to and from the container receiver 100. Particularly in this exemplary embodiment, since the insertion/removal operation direction of the developer container 38 substantially corresponds to the open/close operation direction of the shutter 230, the shutter 230 is set at the open position D merely by completing the insertion of the developer container 38 to the container receiver 100 regardless of the open/close operation of the shutter 230. The developer from the discharge opening 220 of the developer container 38 is successively fed to the reserve tank 110.

Figure 22B:
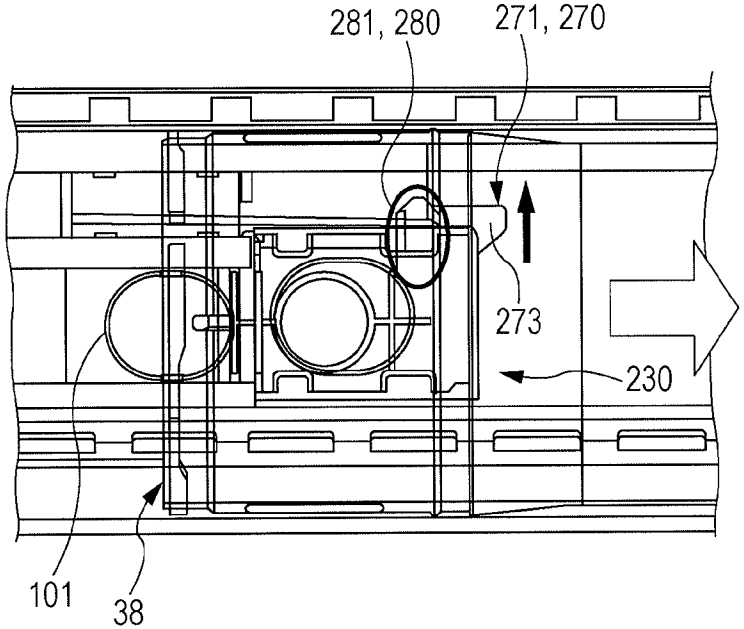
FIGS. 22A and 22B are explanatory views each showing an operation process when the developer container, which has been attached to the container receiver, is removed from the container receiver in the first exemplary embodiment.
Figure 22A:
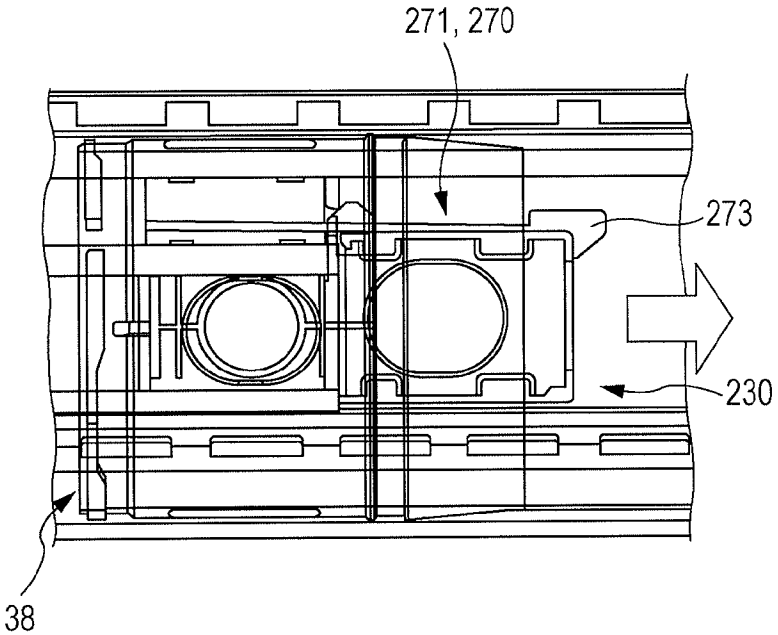

(2) Removal Operation Process of Developer Container (FIGS. 22A and 22B)

When the developer container 38 attached to the container receiver 100 is removed, the shutter 230 is operated as follows.

As shown in FIGS. 22A and 22B, the open/close lid 240 is moved to the close position A by the elastic holding piece 271, and then the holding state of the open/close lid 240 by the elastic holding piece 271 is released by the releasing protruding piece 281. In this state, the developer container 38 is removed from the container receiver 100 while the shutter 230 is located at the close position A.

Figure 23A:
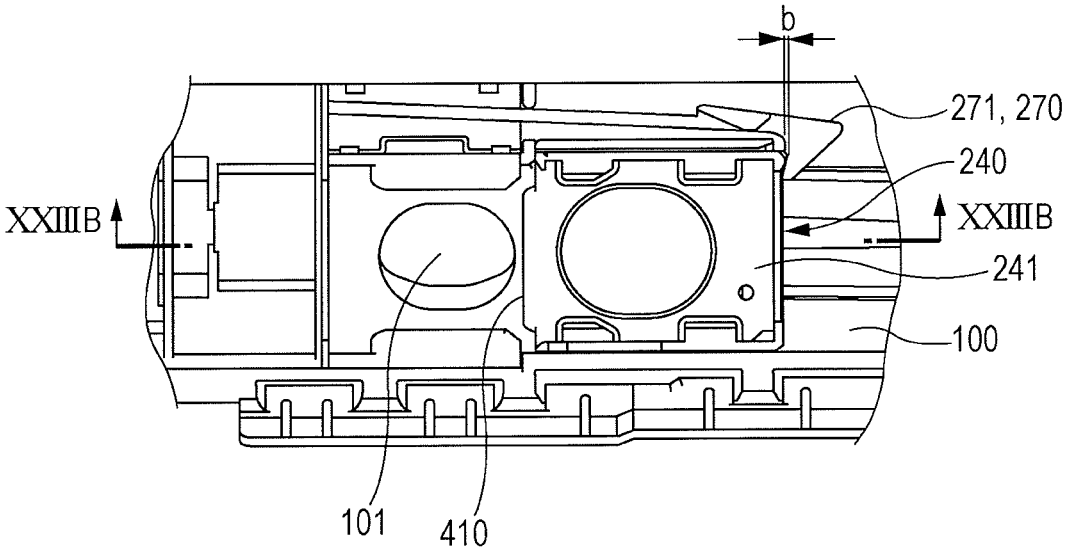
FIG. 23A is an explanatory plan view showing a state in which the open/close lid of the shutter used in this exemplary embodiment is located at the close position.
Figure 23B:
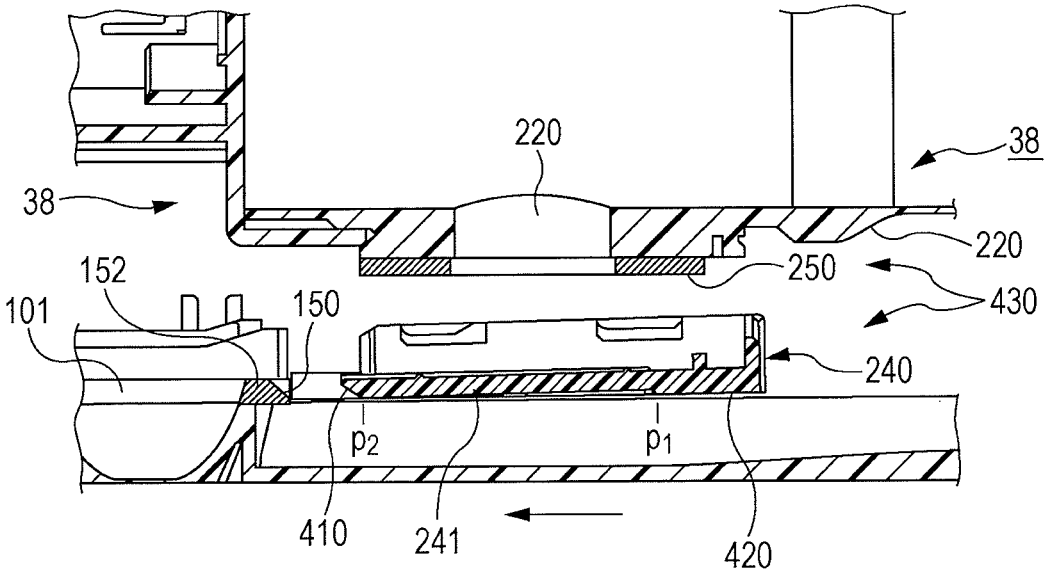
FIG. 23B is a cross-sectional view taken along line XXIIIB-XXIIIB in FIG. 23A, FIG. 23B showing a state immediately before the open/close lid of the shutter reaches the close position.

Shutter Operation Processes of Developer Container Attachment of Developer Container As shown in FIGS. 23A and 23B, it is assumed that the developer container 38 is inserted along a support surface of the container receiver 100, and the open/close lid 240 of the shutter 230 has reached a position near the through hole 101 of the container receiver 100. In this state, if the developer container 38 is further inserted, as shown in FIGS. 23B, 24A, and 24B, the restricting piece 410 of the open/close lid 240 of the shutter 230 contacts an edge portion of the container receiver 100 located in front of the through hole 101.

Figure 24A:
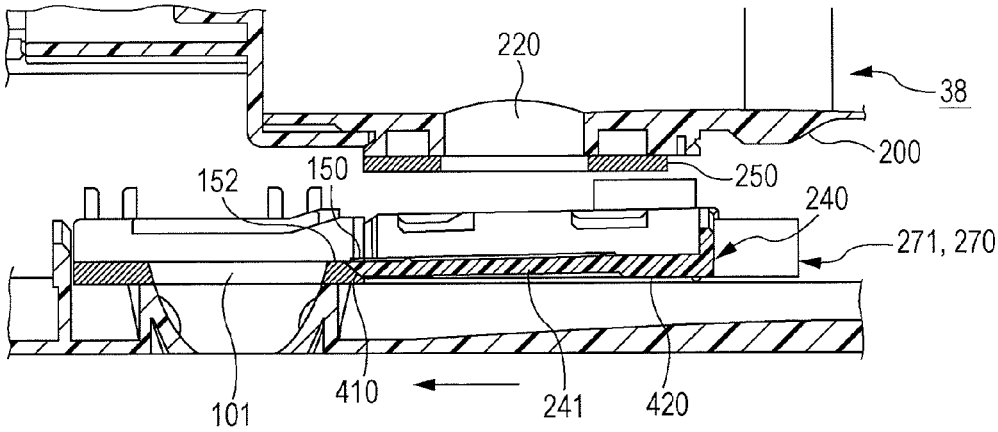
FIGS. 24A and 24B are explanatory views each showing a state in which the open/close lid of the shutter used in this exemplary embodiment moves from the close position to the open position.
Figure 24B:
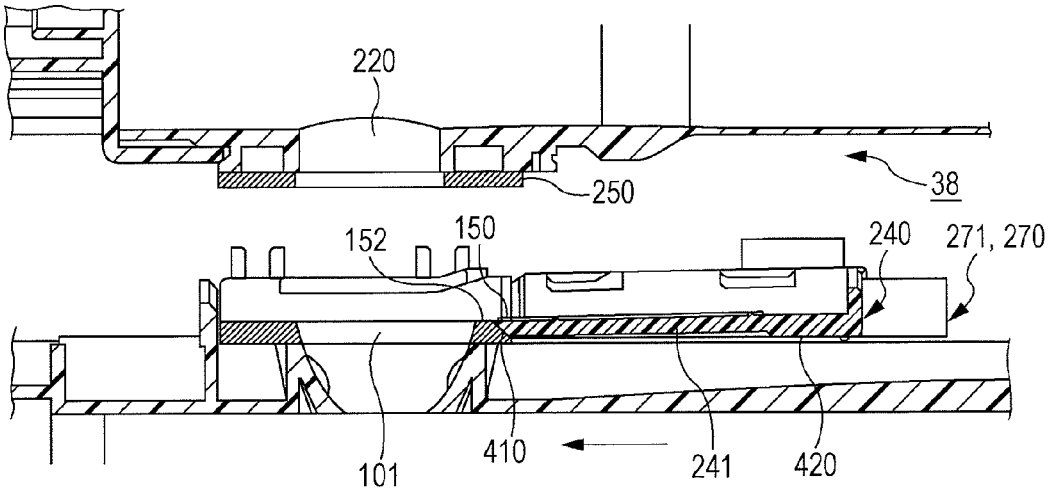

FIGS. 23B, 24A, and 24B each illustrate the open/close lid 240 and the lid holding frame 250 in a separated manner to show the motions of the open/close lid 240 and the lid holding frame 250.

At this time, the edge portion of the container receiver 100 located in front of the through hole 101 has a contact surface 150 formed to be inclined with respect to the open/close operation direction of the open/close lid 240 such that a height of the contact surface 150 is decreased as the contact surface 150 extends away from the through hole 101. Also, the restricting piece 410 of the open/close lid 240 has the inclined surface 411 inclined with respect to the open/close operation direction so as to face the contact surface 150. Hence, the inclined surface 411 of the restricting piece 410 of the open/close lid 240 contacts the contact surface 150.

If the restricting piece 410 of the open/close lid 240 contacts the contact surface 150, the movement of the open/close lid 240 is restrained. If the developer container 38 is further pushed, the discharge opening 220 becomes open with respect to the open/close lid 240 of the shutter 230 by the movement of the container body 200. When the discharge opening 220 has reached the position of the through hole 101 of the container receiver 100, the discharge opening 220 of the developer container 38 is connected with the through hole 101 of the container receiver 100 to the reserve tank 110. The developer is fed from the developer container 38 to the reserve tank 110.

Figure 25A:
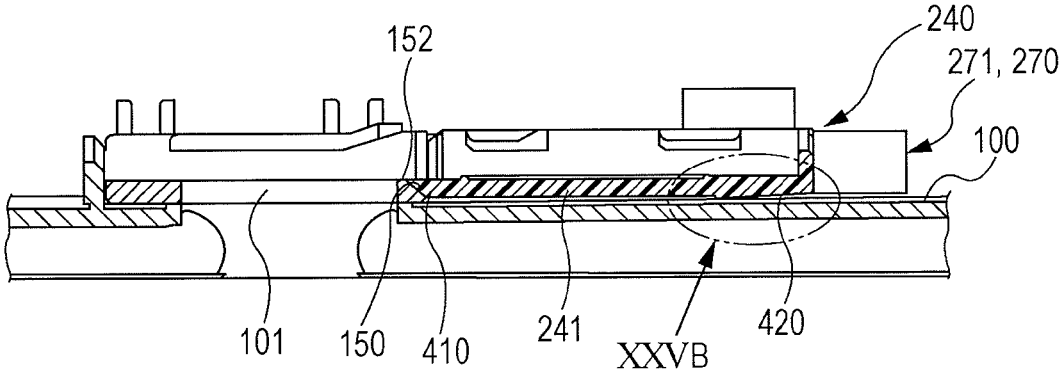
FIG. 25A is an explanatory view showing an engagement state between the open/close lid of the shutter used in this exemplary embodiment and an edge portion of a through hole of the container receiver.
Figure 25B:
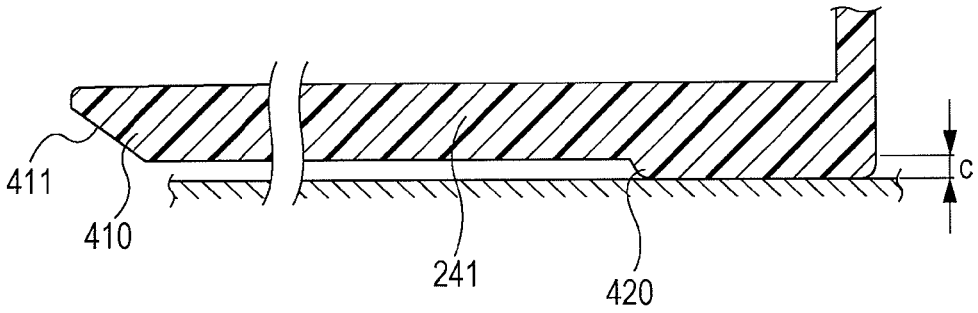
FIG. 25B is an explanatory view showing the detail of part XXVB in FIG. 25A.

At this time, the open/close lid 240 of the shutter 230 has the extending portion 420 as shown in FIGS. 25A and 25B. Thus, as shown in FIGS. 23B and 25B, the open/close lid 240 moves while an end of the extending portion 420 in the moving direction and a proximal end of the restricting piece 410 respectively serve as support points p1 and p2. The restricting piece 410 contacts the contact surface 150 at the edge portion of the through hole 101 while the posture of the restricting piece 410 is adjusted to be inclined forward.

Figure 26A:
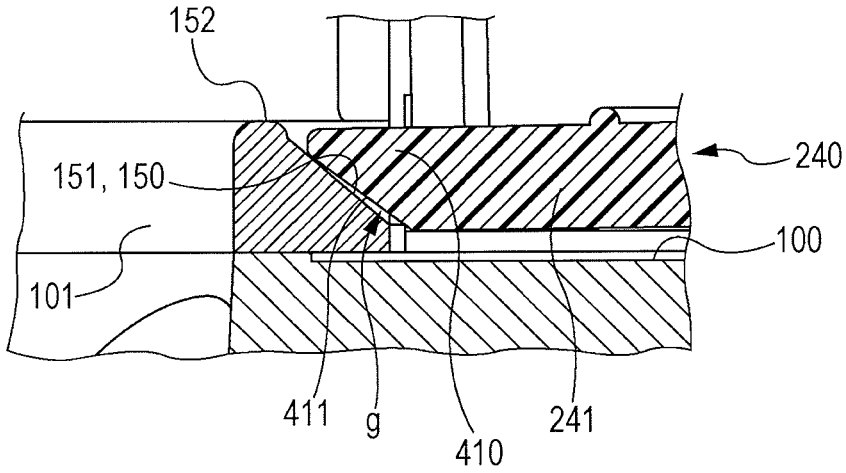
FIGS. 26A and 26B are explanatory views showing the detail of behaviors of a specific area in FIG. 25A.
Figure 26B:
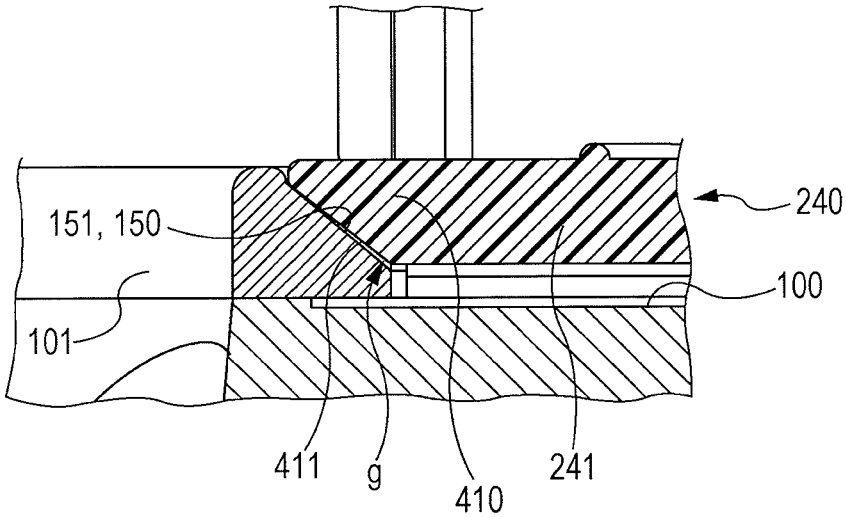

Then, as shown in FIG. 26A, a protruding end of the restricting piece 410 of the open/close lid 240 contacts the contact surface 150. If the restricting piece 410 of the open/close lid 240 is further pressed against the contact surface 150, as shown in FIG. 26B, the restricting piece 410 is pushed up along the contact surface 150 as shown in FIG. 26B. Then, the inclined surface 411 of the restricting piece 410 contacts an inclined surface 151 of the contact surface 150.

At this time, as shown in FIG. 23A, since the open/close lid 240 is held by the elastic holding piece 271 of the lid movably holding mechanism 270, the open/close lid 240 is not unnecessarily retracted from the contact surface 150. If the shutter 230 of the developer container 38 is opened, the developer in the developer container 38 is fed to the reserve tank 110 through the through hole 101 of the container receiver 100 without leaking through the shutter 230.

Detachment of Developer Container

Assuming that the developer container 38 during use is replaced or temporarily removed for maintenance and inspection, as shown in FIG. 23A, since there is the slight play (gap) b between the elastic holding piece 271 of the lid movably holding mechanism 270 and the open/close lid 240 due to manufacturing tolerance etc., when the developer container 38 is to be removed, the open/close lid 240 may be retracted from the contact surface 150 by the amount of the play b.

Figure 27A:
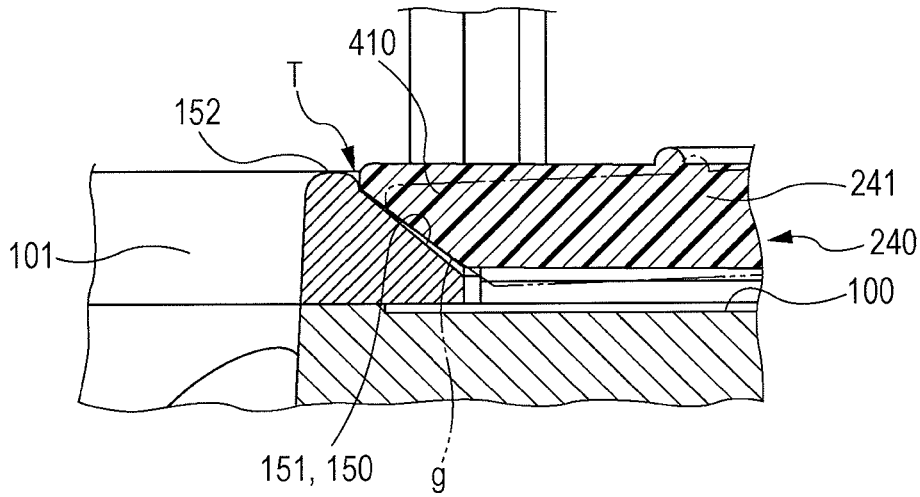
FIG. 27A is an explanatory view showing a state when an operation for detaching the developer container according to this exemplary embodiment is started.

However, if the open/close lid 240 is retracted for the play b, as indicated by two-dotted chain line in FIG. 27A, the posture of the open/close lid 240 is changed to the forward inclined posture toward the restricting piece 410 because of the presence of the extending portion 420 of the open/close lid 240. The protruding end of the restricting piece 410 of the open/close lid 240 contacts the inclined surface 151 of the contact surface 150. A gap g between the contact surface 150 and the restricting piece 410 is closed by the restricting piece 410.

At this time, when the developer container 38 is to be removed from the container receiver 100 for the detachment of the developer container 38, the discharge opening 220 of the developer container 38 is moved while being open until the discharge opening 220 is closed with the open/close lid 240. Hence, the developer T in the developer container 38 may be dropped on the periphery of the through hole 101 of the container receiver 100. However, the developer T rarely leaks to the container receiver 100 through the gap g between the contact surface 150 and the restricting piece 410.

Figure 27B:
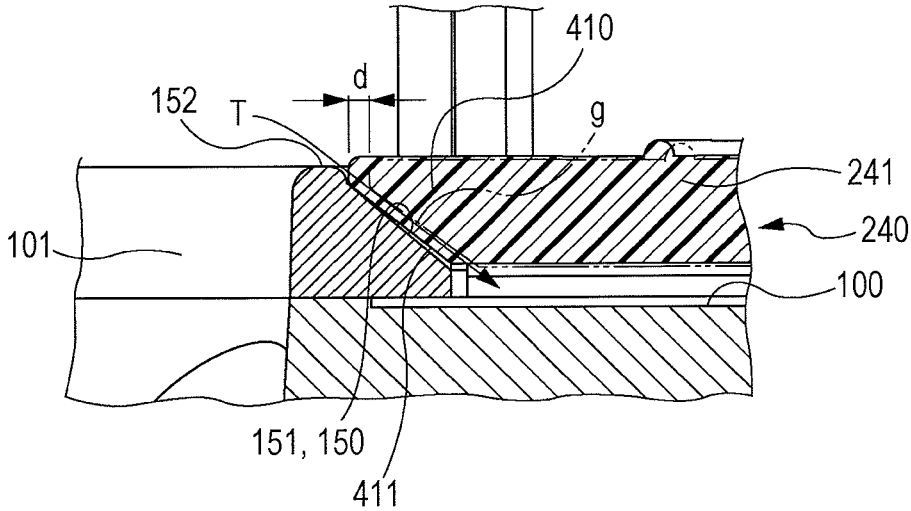
FIG. 27B is an explanatory view showing a state when an operation for detaching a developer container according to a comparative exemplary embodiment is started.

Regarding this point, in a comparative exemplary embodiment (in which the configuration of the extending portion 420 is removed from the shutter according to the exemplary embodiment) shown in FIG. 27B, the moving path of the open/close lid 240 is along the support surface of the container receiver 100. Hence, if the open/close lid 240 is retracted by the play b, as indicated by an imaginary line in FIG. 27B, the inclined surface 411 of the restricting piece 410 of the open/close lid 240 is retracted from the contact surface 150 while the posture of the inclined surface 411 is maintained. Hence, a gap g may be formed between the contact surface 150 and the restricting piece 410 of the open/close lid 240. Accordingly, if the developer T in the developer container 38 is dropped on the periphery of the through hole 101 of the container receiver 100, the developer T may leak to the container receiver 100 through the gap g between the contact surface 150 and the restricting piece 410.

Figure 28A:
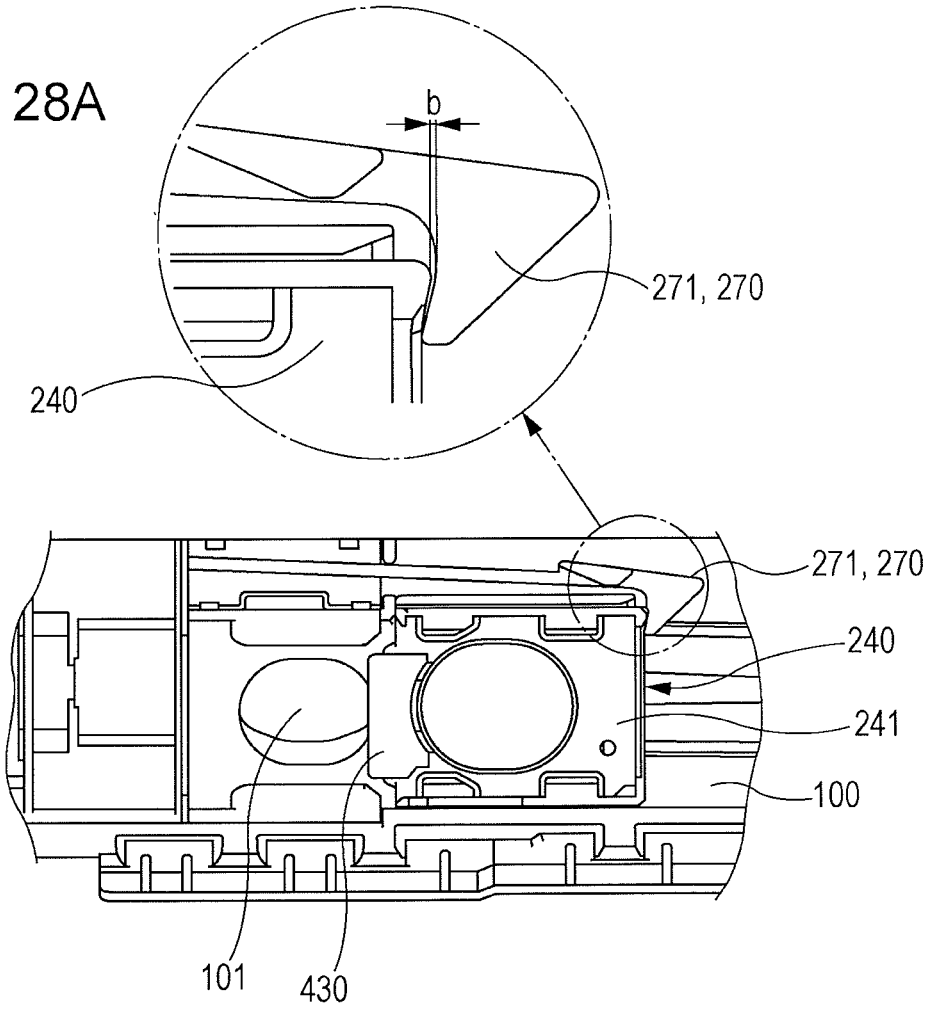
FIG. 28A is an explanatory plan view showing a state in which an open/close lid of a shutter (exemplary embodiment in which a sealing member is added to a basic configuration) used in a second exemplary embodiment is located near an edge portion of a through hole of a container receiver.
Figure 28B:
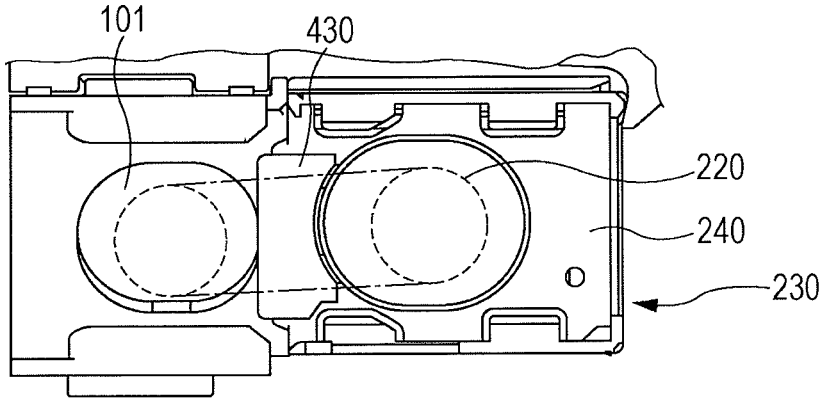
FIG. 28B is an explanatory view showing a moving path of an opening of the shutter when the developer container is inserted, the shutter illustrated in any of FIGS. 29A to 31B representing an exemplary embodiment in which the sealing member is added to the basic configuration.

Exemplary Embodiment with Sealing Member Added to Basic Configuration of Shutter FIGS. 28A and 28B show an exemplary embodiment in which the sealing member 430 is added to the basic configuration of the shutter 230 according to the first exemplary embodiment.

In FIGS. 28A and 28B, the shutter 230 has the above-described basic configurations (see FIGS. 10 to 27B) and also additionally has the sealing member 430 for sealing at the open/close lid 240. Like numerals refer like components as of the basic configuration of the shutter 230, and the detailed description thereof will be omitted.

An example of the sealing member 430 is formed of a flexible film made of, for example, PET. The sealing member 430 protrudes from an edge of the open/close lid 240 near the opening 220 when the open/close lid 240 is located at the open position at which the opening 220 is open. The sealing member 430 closes the gap g between the contact surface 150 at the edge portion of the through hole 101 of the reserve tank 110 and the restricting piece 410.

In this exemplary embodiment, as shown in FIGS. 28B, and 29A to 29C, the sealing member 430 is bonded to an inner surface of the open/close lid 240 by an adhesive (not shown). The sealing member 430 protrudes outward with respect to the restricting piece 410 of the open/close lid 240. As shown in FIG. 28B, the sealing member 430 has a larger width than the discharge opening 220. In FIG. 28B, the opening 220 is moved as indicated by dotted-chain lines in FIG. 28B when the shutter 230 is opened and closed.

Figure 30A:
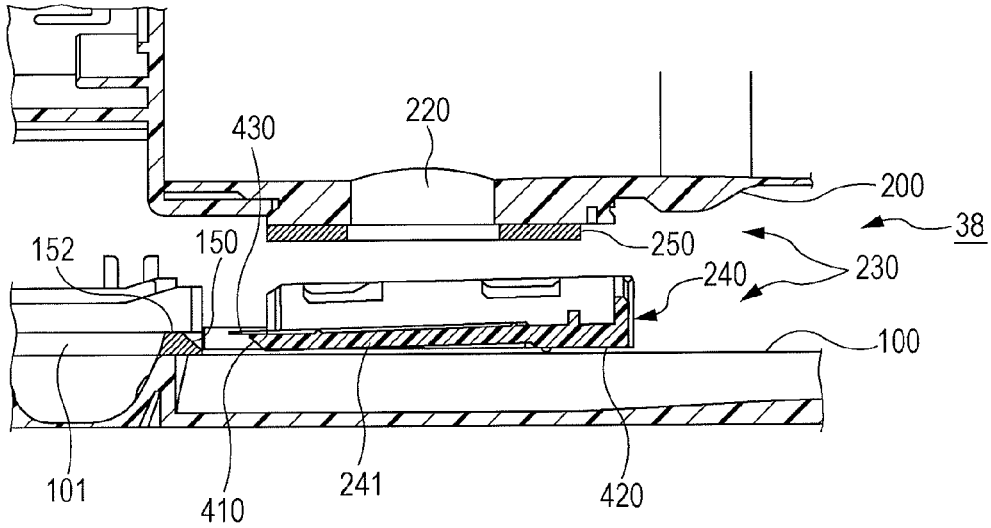
FIGS. 30A and 30B are explanatory views each showing an operation process for inserting the developer container according to the first exemplary embodiment.
Figure 30B:
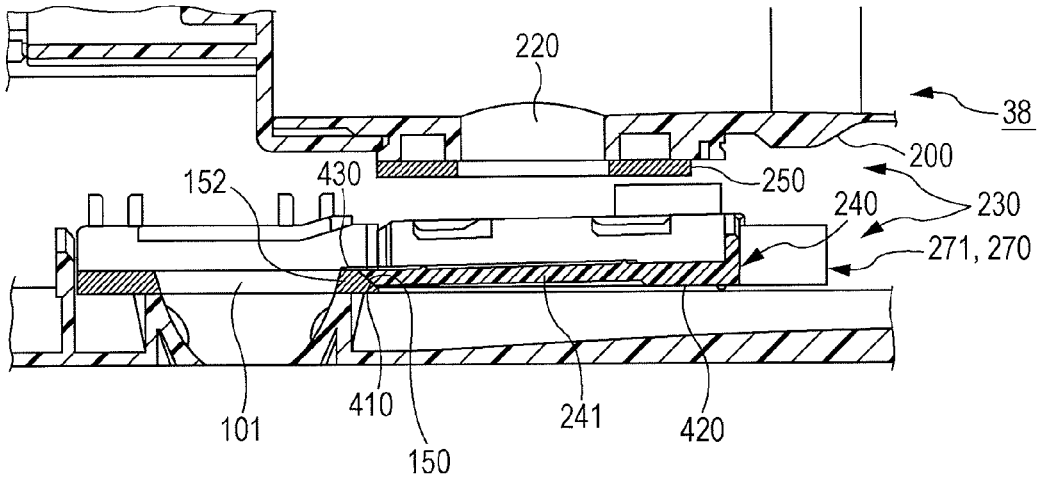
Figure 31A:
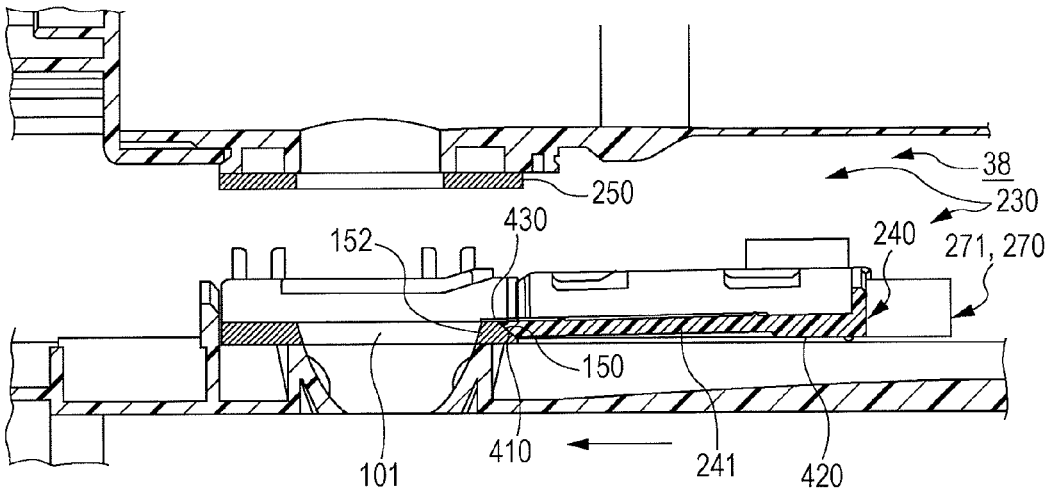
FIG. 31A is an explanatory view showing a state in which the insertion operation for the developer container according to the first exemplary embodiment is completed.

Next, referring to FIGS. 30 and 31, the operation state in the periphery of the shutter 230 when the developer container 38 is attached and detached is described with reference to FIGS. 30A to 31B. FIGS. 30A, 30B, and 31A each illustrate the open/close lid 240 and the lid holding frame 250 in a separated manner to show the motions of the open/close lid 240 and the lid holding frame 250.

As shown in FIGS. 30A, 30B, 31A, and 31B, when the developer container 38 is to be attached to the container receiver 100, the restricting piece 410 of the open/close lid 240 of the shutter 230 contacts the contact surface 150 at the edge portion of the through hole 101 of the container receiver 100, the shutter 230 becomes open, and the opening 220 of the developer container 38 is connected with the through hole 101 of the container receiver 100.

At this time, the open/close lid 240 of the shutter 230 opens the opening 220 through an operation process that is substantially similar to the first exemplary embodiment.

Also, the forward inclined posture of the sealing member 430 of the open/close lid 240 is maintained by the presence of the extending portion 420 of the open/close lid 240. Hence, the sealing member 430 contacts the contact surface 150, then rises along the contact surface 150, and is pressed against an edge portion 152 of the through hole 101 of the container receiver 100.

In this exemplary embodiment, when the developer container 38 is attached to the container receiver 100, the restricting piece 410 of the open/close lid 240 contacts the contact surface 150. Also, the sealing member 430 is pressed against the edge portion 152 of the through hole 101 of the container receiver 100, and closes the gap between the contact surface 150 and the restricting piece 410 of the open/close lid 240.

Accordingly, when the developer container 38 is attached to the container receiver 100, the developer is fed from the developer container 38 to the reserve tank 110 through the through hole 101 of the container receiver 100. The developer does not leak from the periphery of the through hole 101.

Figure 31B:
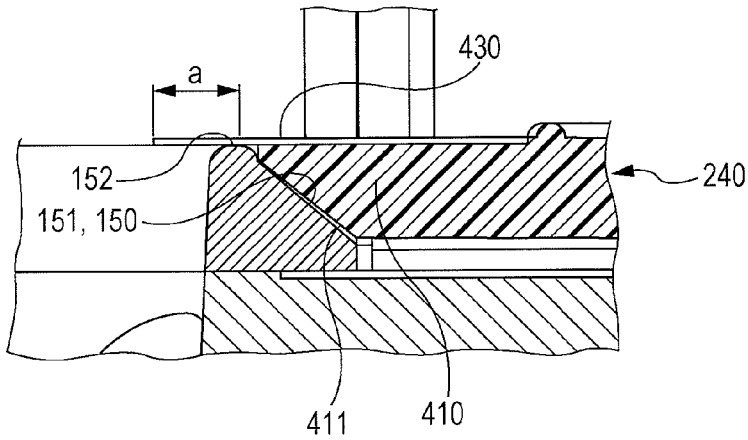
FIG. 31B is an explanatory view showing an arrangement state of a sealing member in the state shown in FIG. 31A.

Also, in this exemplary embodiment, as shown in FIG. 31B, if it is assumed that a is a protruding length of the sealing member 430 from the edge portion 152 of the through hole 101, the dimension of the sealing member 430 is determined to satisfy the relationship of a>b, with respect to the play b between the elastic holding piece 271 of the lid movably holding mechanism 270 and the open/close lid 240.

Accordingly, in this exemplary embodiment, when the developer container 38 during use is replaced or temporarily detached for maintenance and inspection, if the developer container 38 is to be detached, the open/close lid 240 may be retracted from the contact surface 150 by the play b.

However, even if the open/close lid 240 is retracted, the forward inclined posture of the open/close lid 240 is maintained by the presence of the extending portion 420. The state in which the restricting piece 410 of the open/close lid 240 is tilted down toward and contacts the contact surface 150 is maintained, and in addition, the state in which the sealing member 430 is pressed against the edge portion 152 of the through hole 101 is maintained. When the developer container 38 is to be removed from the container receiver 100, the discharge opening 220 of the developer container 38 is moved while being open until the discharge opening 220 is closed with the open/close lid 240. Hence, the developer in the developer container 38 may be dropped on the periphery of the through hole 101 of the container receiver 100. However, the developer is effectively prevented from leaking to the container receiver 100 through the gap between the contact surface 150 and the restricting piece 410.

Figure 29A:
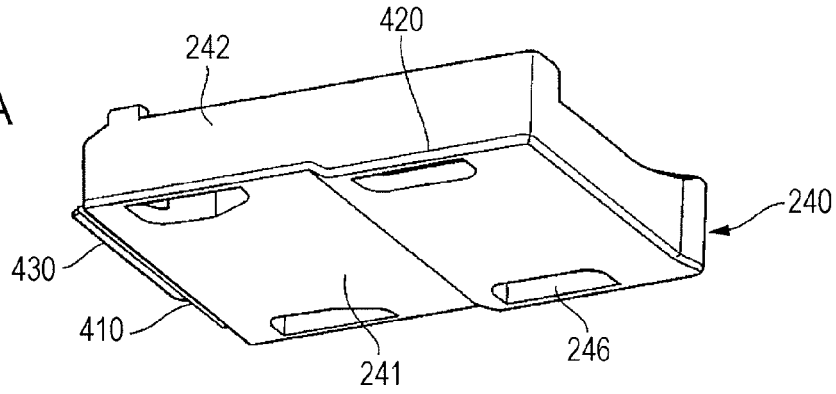
FIG. 29A is a perspective view of the open/close lid of the shutter used in the first exemplary embodiment when viewed from the outside.
Figure 29B:
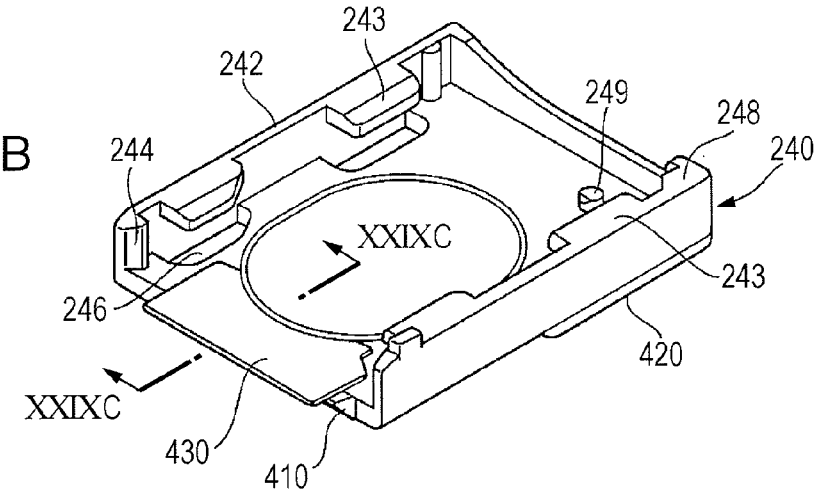
FIG. 29B is a perspective view showing the inside of the open/close lid in FIG. 29A.
Figure 29C:
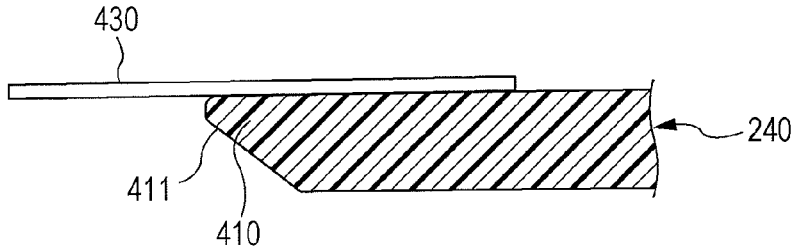
FIG. 29C is a cross-sectional view taken along line XXIXC-XXIXC in FIG. 29B.
Figure 29D:
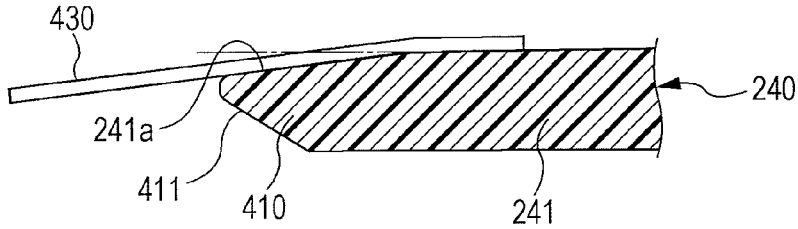
FIG. 29D is an explanatory view showing a modification of FIG. 29C.

In this exemplary embodiment, the sealing member 430 is pressed against the edge portion 152 of the through hole 101 while the forward inclined posture is maintained by the presence of the extending portion 420 of the open/close lid 240. However, if it is required to further strongly press the sealing member 430, for example, as shown in FIG. 29D, an inclined portion 241*a* that is inclined forward toward the through hole 101 may be provided at a portion of the lid body 241 of the open/close lid 240. By bonding the sealing member 430 to the inclined portion 241*a*, the forward inclined posture of the sealing member 430 may be enhanced. This exemplary embodiment is based on the exemplary embodiment in which the open/close lid 240 is provided with the extending portion 420. Particularly in an exemplary embodiment in which the open/close lid 240 is not provided with the extending portion 420, of course, an inclined portion 241*a* that is inclined forward toward the through hole 101 may be provided at the open/close lid 240, so as to press the protruding free end of the sealing member 430 against the edge portion 152 of the through hole 101 of the container receiver 100.

In this exemplary embodiment, as shown in FIG. 31B, the contact surface 150 of the edge portion 152 of the through hole 101 has the inclined surface 151 that is inclined with respect to the open/close operation direction of the open/close lid 240 such that a height of the inclined surface 151 is decreased as the inclined surface 151 extends away from the through hole 101, and the restricting piece 410 has the inclined surface 411 that is inclined with respect to the open/close operation direction to face the inclined surface 151. However, it is not limited thereto. An exemplary embodiment in which the contact surface 150 and the restricting piece 410 have vertical surfaces that intersect with the open/close operation direction of the open/close lid 240 may be applied to this exemplary embodiment.

Shutter Structure with Sealing Member

Figure 32A:
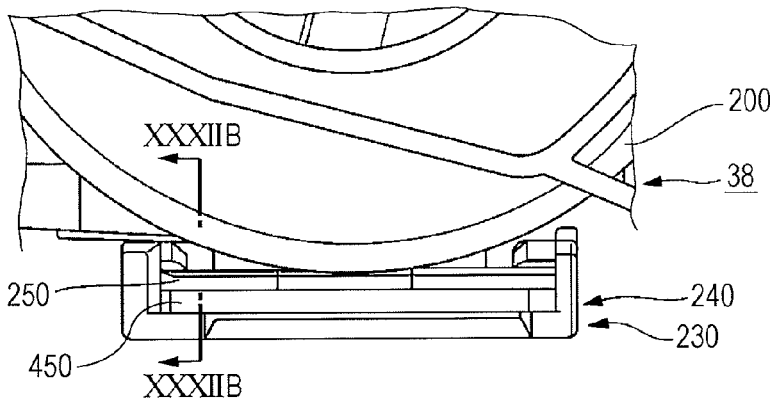
FIG. 32A is an explanatory view showing a specific area of a modification of the first exemplary embodiment.
Figure 32B:
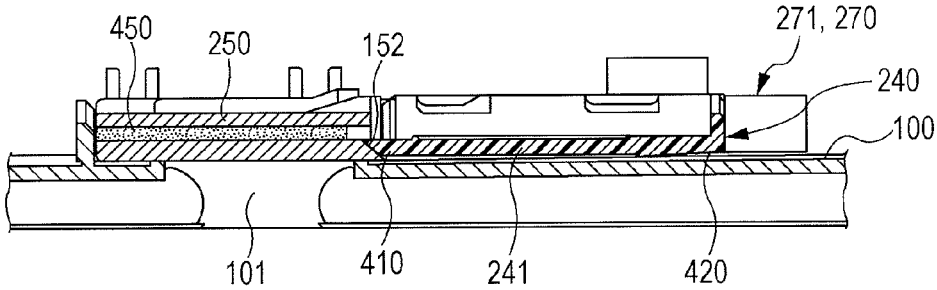
FIG. 32B is a cross-sectional view taken along line XXXIIB-XXXIIB in FIG. 32A.

As shown in FIGS. 32A and 32B, in an exemplary embodiment in which an elastic sealing member 450 (for example, made of silicon rubber) is bonded to a peripheral edge of the opening 220 of the lid holding frame 250, the shutter 230 may be closed with the sealing member 450 arranged between the lid holding frame 250 and the open/close lid 240. Sealing performance of the developer container 38 becomes high.

Figure 32C:
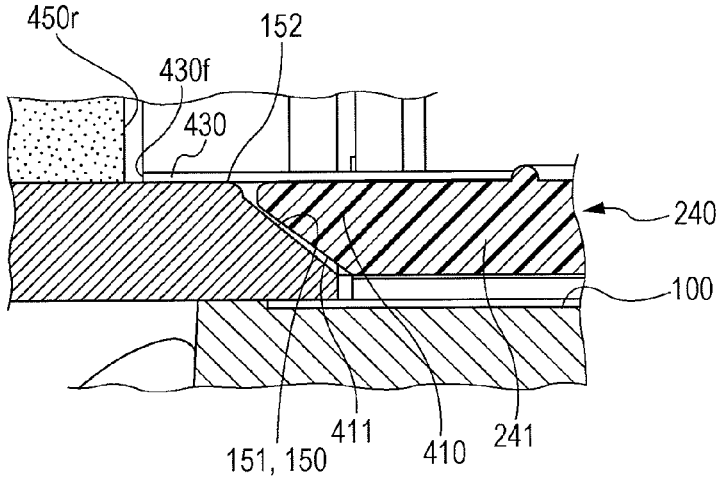
FIG. 32C is an explanatory view showing a peripheral structure of the sealing member.

In this exemplary embodiment, the sealing member 430 of the open/close lid 240 extends so as to be pressed against the edge portion 152 of the through hole 101 of the container receiver 100 when the open/close lid 240 becomes the forward inclined posture. When the open/close lid 240 is located at the open position, as shown in FIG. 32C, a distal end 430*f* of the sealing member 430 is removed from an end 450*r* of the sealing member 450 located near the open/close lid 240.

In this exemplary embodiment, when the developer container 38 is temporarily detached from the container receiver 100, the opening 220 of the developer container 38 passes the peripheral edge portion of the through hole 101 of the container receiver 100 while the opening 220 is exposed in the process of removing the developer container 38 from the container receiver 100. Hence, the developer may be dropped on the edge portion 152 of the through hole 101.

In this situation, a distal end of the sealing member 430 of the open/close lid 240 scrapes the developer dropped on the edge portion 152 of the through hole 101 before the open/close lid 240 of the shutter 230 closes the opening 220. In this case, a back surface of the distal end of the sealing member 430 may be contaminated with the developer; however, in this exemplary embodiment, the distal end of the sealing member 430 is inserted between the edge portion 152 of the through hole 101 and the sealing member 450 and the sealing member 450 wipes the back surface of the distal end of the sealing member 430 during the process in which the open/close lid 240 moves toward the close position.

At this time, since the posture of the open/close lid 240 is the forward inclined posture, the edge portion 152 of the through hole 101 is inclined such that the distal end of the sealing member 430 is pressed against thereto. When the open/close lid 240 moves to the close position, the distal end of the sealing member 430 is inserted between the edge portion 152 of the through hole 101 and the sealing member 450 without the distal end of the sealing member 430 being rolled up inversely.

Second Embodiment

Figure 33A:
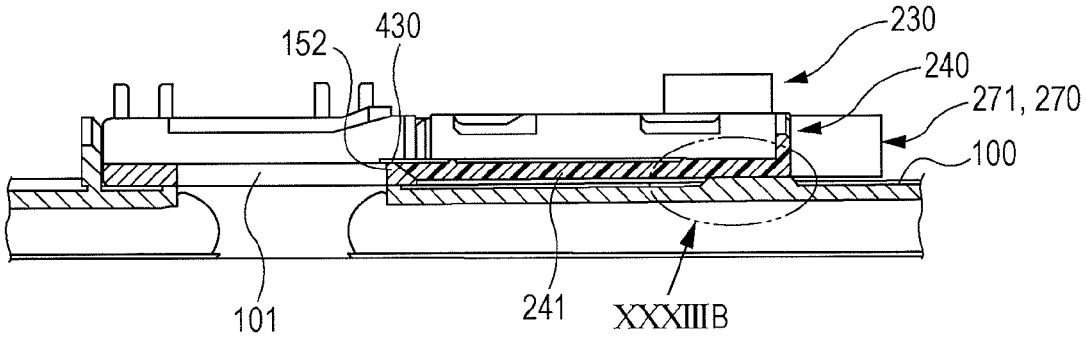
FIG. 33A is an explanatory view showing a specific area of a developer container and a container receiver according to a second exemplary embodiment.

FIG. 33A shows a specific area of a container receiver and a structure in the periphery of a shutter of a developer container provided in an image forming apparatus according to a second exemplary embodiment.

In FIG. 33A, a feature configuration of a shutter 230 of a developer container 38 is substantially similar to that of the first exemplary embodiment except for a configuration of an open/close lid 240 of the shutter 230 and a configuration of a container receiver 100. Like numerals refer like components as in the first exemplary embodiment, and the detailed description thereof will be omitted.

Figure 34A:
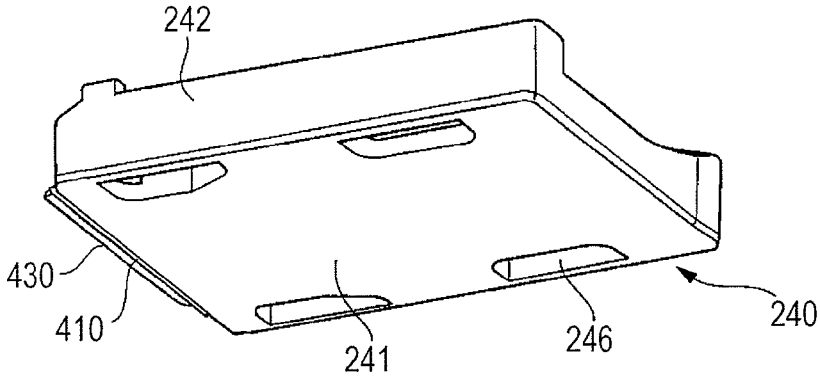
FIG. 34A is a perspective view of an open/close lid of a shutter used in the second exemplary embodiment when viewed from the outside.
Figure 34B:
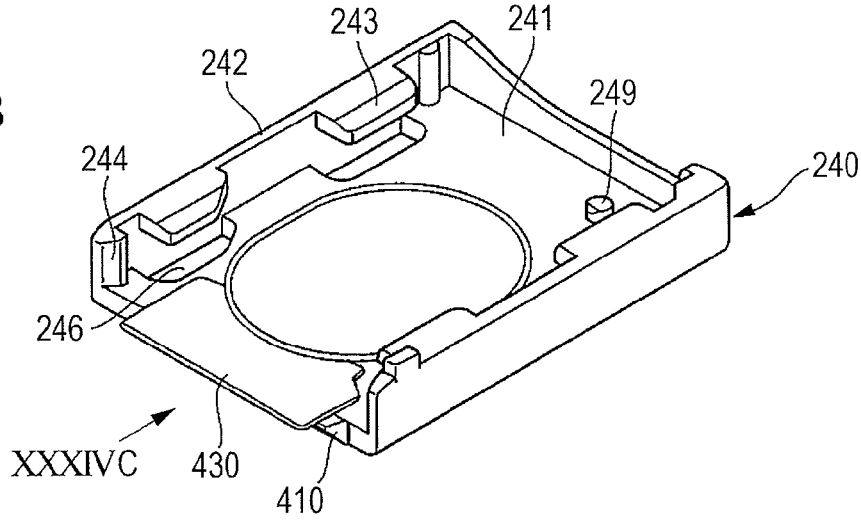
FIG. 34B is a perspective view showing the inside of the open/close lid in FIG. 34A.
Figure 34C:
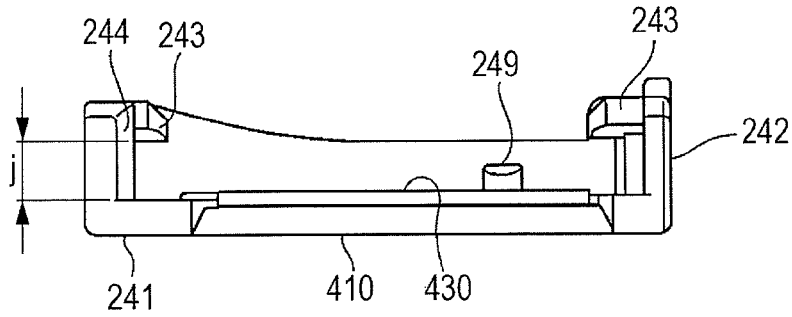
FIG. 34C is a view from arrow XXXIVC in FIG. 34B.

In this exemplary embodiment, as shown in FIGS. 34A to 34C, the open/close lid 240 of the shutter 230 is similar to that of the first exemplary embodiment except that a lid body 241 does not include an extending portion 420 (see FIGS. 11A to 11C) and an outer surface of the lid body 241 is a flat plane without a step.

Figure 33B:
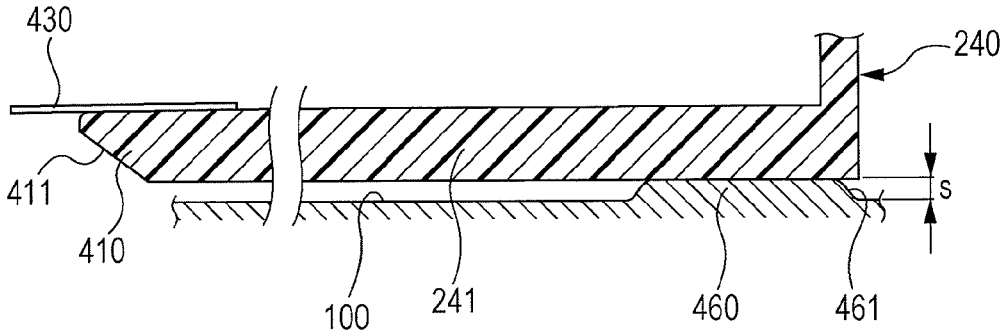
FIG. 33B is an explanatory view showing the detail of part XXXIIIB in FIG. 33A.

As shown in FIGS. 33A and 33B, the container receiver 100 is integrally or separately formed with a step portion 460 as an example of a second restricting portion on a support surface of the developer container 38 at a position in front of the through hole 101.

This step portion 460 is provided at a position such that the step portion 460 contacts an outer surface of the lid body 241 of the open/close lid 240 at a side apart from the through hole 101 of the container receiver 100 when the open/close lid 240 of the shutter 230 is located at the open position. The step portion 460 is bulged from the residual support surface by a step s (in this exemplary embodiment, substantially corresponding to an extending length c of the extending portion 420 of the first exemplary embodiment) that restricts the posture of the open/close lid 240 to become the forward inclined posture when the restricting piece 410 of the open/close lid 240 contacts the contact surface 150 of the edge portion 152 of the through hole 101 of the container receiver 100.

A rising corner portion 461 of the step portion 460 located at a side opposite to the through hole 101 serves as a curved surface portion so that the open/close lid 240 is easily put on the step portion 460 when the developer container 38 is inserted along the support surface of the container receiver 100 in the process of attaching the developer container 38.

Hence, with this exemplary embodiment, an advantage similar to that of the first exemplary embodiment is attained when the developer container is attached or detached.

Third Embodiment

Figure 35A:
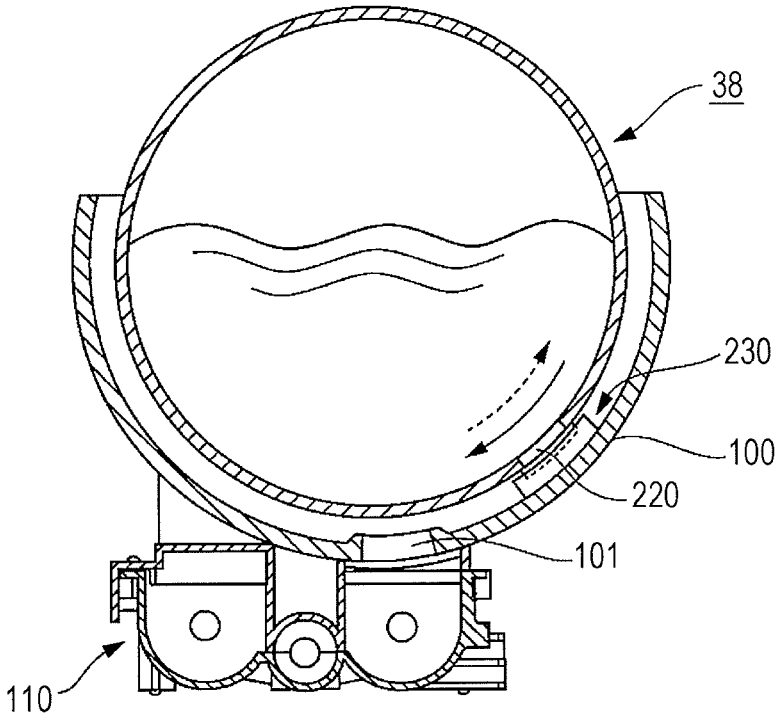
FIG. 35A is an explanatory view showing a specific area of a developer container and a container receiver used in a third exemplary embodiment.

FIG. 35A shows a specific area of a developer supply system provided in an image forming apparatus according to a fourth exemplary embodiment.

Referring to FIG. 35A, similarly to the first exemplary embodiment, the developer supply system is formed at a portion of an apparatus casing 21, and includes a container receiver 100 to which a developer container 38 is detachably attached. A reserve tank 110 that temporarily reserves a developer for supply is arranged below the container receiver 100, so that the developer is supplied to the reserve tank 110 through a through hole 101 of the container receiver 100.

In this exemplary embodiment, when the developer container 38 is attached to the container receiver 100, the developer container 38 is inserted to a housing position that is predetermined with respect to the container receiver 100, and then is set at a set position by rotating the developer container 38 in a predetermined arrow direction indicated by a solid line. When the developer container 38 is detached from the container receiver 100, the developer container 38 is rotated in an arrow direction indicated by a dotted line from the set position and then is removed.

Particularly in this exemplary embodiment, a shutter 230 of the developer container 38 includes an open/close lid 240 that closes a discharge opening 220 of a cylindrical container body 200, and a lid holding frame 250 that holds the open/close lid 240 movably in an open/close operation direction (in this exemplary embodiment, corresponding to a rotation direction of the cylindrical container body 200).

Figure 35B:
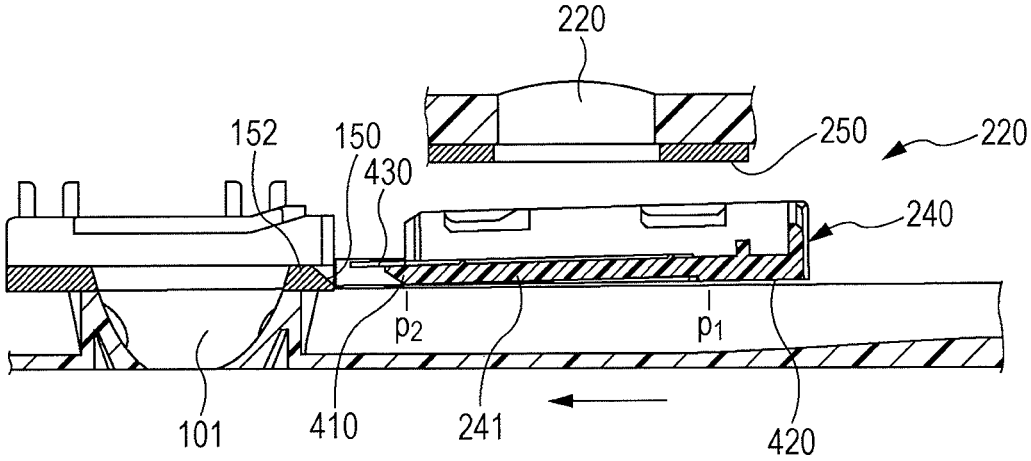
FIG. 35B is an explanatory view schematically showing an open/close operation of a shutter of the developer container.

Also, FIG. 35B schematically shows a peripheral structure of the through hole 101 of the container receiver 100 and the shutter 230 of the developer container 38. FIG. 35B illustrates the open/close lid 240 and the lid holding frame 250 in a separated manner to show the motions of the open/close lid 240 and the lid holding frame 250.

In this exemplary embodiment, a contact surface 150 is formed at a portion, to which the open/close lid 240 of the shutter 230 contacts, of the edge portion 152 of the through hole 101 of the container receiver 100. The contact surface 150 is inclined with respect to the open/close operation direction (in this exemplary embodiment, the rotation operation direction) of the open/close lid 240 such that a height of the contact surface 150 is decreased as the contact surface 150 extends away from the through hole 101. A basic configuration of the shutter 230 is substantially similar to that of the first exemplary embodiment except that the rotation operation direction of the open/close lid 240 is different from that of the first exemplary embodiment. A restricting piece 410 is provided at a portion, which contacts the contact surface 150, of the open/close lid 240 of the shutter 230 to face the contact surface 150. The restricting piece 410 is inclined with respect to the open/close operation direction (in this exemplary embodiment, the rotation operation direction) of the open/close lid 240. An extending portion 420 and a sealing member 430 are provided at a portion on an outer surface of the lid body 241 of the open/close lid 240 at a position apart from the restricting piece 410. The extending portion 420 extends from the residual outer surface by a step. The container receiver 100 includes a lid guide rail (not shown) that causes the developer container 38 to be inserted to the housing position and to be rotated at the housing position. Also, the container receiver 100 includes a lid movably holding mechanism (not shown) that holds the open/close lid 240 of the shutter 230 at the open position, and a lid releasing mechanism (not shown) that releases the lid movably holding mechanism.

Like numerals refer like components as in the first exemplary embodiment, and the detailed description thereof will be omitted.

Next, an operation state in the periphery of the shutter when the developer container 38 is attached or detached according to this exemplary embodiment will be described.

When the developer container 38 is attached to the container receiver 100, if the developer container 38 is inserted to the housing position in the container receiver 100 and then is rotated in the direction indicated by the solid line, as shown in FIGS. 35A and 35B, the open/close lid 240 moves in the forward inclined posture while an end of the extending portion 420 in the moving direction and a proximal end of the restricting piece 410 respectively serve as support points p1 and p2.

Thereafter, if the restricting piece 410 of the open/close lid 240 contacts the contact surface 150 of the edge portion 152 of the through hole 101, the movement of the open/close lid 240 is restricted. Then, if the developer container 38 is further rotated, the open/close lid 240 relatively moves from the close position to the open position, the opening 220 of the developer container 38 reaches the position corresponding to the through hole 101, and the opening 220 and the through hole 101 are connected with each other. In this state, the developer container 38 is set at the set position of the container receiver 100.

Also, when the developer container 38 is detached from the container receiver 100, the developer container 38 is rotated to cause the shutter 230 to become the closed state, and then is removed.

When the developer container 38 is rotated, the open/close lid 240 is held at the open position by the lid movably holding mechanism (not shown). At this time, a gap g due to manufacturing tolerance etc. is present between the holding position by the lid movably holding mechanism and the open/close lid 240. Hence, the open/close lid 240 may be slightly retracted from the contact surface 150. However, as descried in the first exemplary embodiment for example, since the open/close lid 240 is configured such that the forward inclined posture is maintained by the presence of the extending portion 420, the sealing member 430 contacts the edge portion 152 of the through hole 101 of the container receiver 100 in a pressed manner, the state in which the distal end of the restricting piece 410 contacts the contact surface 150 is maintained, and the gap g between the contact surface 150 and the restricting piece 410 is closed (see FIG. 27A). Accordingly, when the shutter 230 is closed, even if the opening 220 of the developer container 38 passes the edge portion 152 of the through hole 101 of the container receiver 100 while the opening 220 is exposed and the developer is dropped, the developer rarely leaks from the gap g between the contact surface 150 and the restricting piece 410 and hence rarely stays on the periphery of the through hole 101 of the container receiver 100.

In this exemplary embodiment, of course, the design may be appropriately changed, for example, by providing the step portion 460 according to the third exemplary embodiment instead of the extending portion 420 of this exemplary embodiment.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A powder container that is detachably attached to a container receiver of a powder processing apparatus casing and that houses powder, comprising:

a container body that houses the powder, the container body having an opening that is formed in a portion of the container body at a position corresponding to a powder opening that is formed in the container receiver;

an open/close lid that is movable between an open position at which the opening is open and a close position at which the opening is closed;

a first restricting portion that is provided at a portion of the open/close lid at a position at a forward side in an attachment operation direction of the container body, a contact surface being located upstream of the powder opening of the container receiver in the attachment operation direction of the container body and being formed to intersect with an open/close operation direction of the open/close lid, the first restricting portion being formed to face the contact surface, when the container body is attached to the container receiver, the first restricting portion being configured to contact the contact surface to restrict a position of the open/close lid in the open/close operation direction of the open/close lid;

a flexible sealing member having a protruding free end that protrudes from an edge of the open/close lid near the opening when the open/close lid is located at the open position at which the opening is open, the protruding free end contacting an edge portion of the powder opening and closing a portion, which is located near the opening, of a gap between the contact surface and the first restricting portion; and a second restricting portion, a press member being provided at the container receiver and restricting movement of the open/close lid in a detachment direction of the container body until the open/close lid reaches the close position at which the opening is closed, when the container body is detached from the container receiver and when the press member restricts the movement of the open/close lid, the second restricting portion being configured to restrict a posture of the sealing member such that the protruding free end of the sealing member is pressed against the edge portion of the powder opening at a position at which the first restricting portion contacts the contact surface.

2. The powder container according to claim 1, wherein the container receiver of the powder processing apparatus casing extends in a direction facing a vertical wall extending in a vertical direction of the powder processing apparatus casing, and wherein the attachment operation direction of the container body to the container receiver is a direction in which the container body is inserted along the container receiver.

3. The powder container according to claim 2, wherein the second restricting portion is provided to extend toward the container receiver at a portion, which is apart from the first restricting portion, of an outer surface, which faces the container receiver, of the open/close lid, is arranged to contact the container receiver, and restricts the posture of the sealing member by causing the posture of the open/close lid with respect to the container receiver to be inclined forward toward the first restricting portion.

4. The powder container according to claim 2, wherein the second restricting portion restricts the posture of the sealing member such that a mount surface for the sealing member at the open/close lid is configured as an inclined surface that is inclined forward toward the powder opening.

5. A powder processing apparatus, comprising:

a powder processing apparatus casing including a container receiver; and the powder container according to claim 2, the powder container being configured to be detachably attached to the container receiver and to house the powder.

6. The powder container according to claim 1, wherein the second restricting portion is provided to extend toward the container receiver at a portion, which is apart from the first restricting portion, of an outer surface, which faces the container receiver, of the open/close lid, is arranged to contact the container receiver, and restricts the posture of the sealing member by causing the posture of the open/close lid with respect to the container receiver to be inclined forward toward the first restricting portion.

7. The powder container according to claim 6, wherein the container receiver has the contact surface that is located upstream of the powder opening in the attachment operation direction of the container body and is inclined with respect to the open/close operation direction of the open/close lid such that a height of the contact surface is decreased as the contact surface extends away from the powder opening, and wherein the first restricting portion has an inclined surface that is inclined with respect to the open/close operation direction to face the contact surface.

8. The powder container according to claim 1, wherein the second restricting portion restricts the posture of the sealing member such that a mount surface for the sealing member at the open/close lid is configured as an inclined surface that is inclined forward toward the powder opening.

9. The powder container according to claim 1, wherein the edge of the opening of the container body has an elastic close-contact member that contacts the edge portion of the powder opening, and wherein the protruding free end of the sealing member is able to be inserted between the close-contact member and the edge portion of the powder opening.

10. A powder processing apparatus, comprising:

a powder processing apparatus casing including a container receiver; and the powder container according to claim 1, the powder container being configured to be detachably attached to the container receiver and to house the powder.

11. The powder processing apparatus according to claim 10, wherein the container receiver of the powder processing apparatus casing further includes a lid guide rail that guides a moving path of the open/close lid of the powder container, a lid movably holding mechanism that contacts the open/close lid, moves the open/close lid toward the open position, and then holds the open/close lid when the attachment of the powder container is completed, and also moves the open/close lid at the open position toward the close position by pressing the open/close lid by the press member when the powder container is detached, and a lid releasing mechanism that releases a holding state by the lid movably holding mechanism when the powder container is detached and when the open/close lid has reached the close position.

12. The powder processing apparatus according to claim 11, wherein a>b is satisfied, where b is a gap between the open position of the open/close lid provided by the lid movably holding mechanism and the open/close lid, and a is a protruding length of the sealing member from a contact portion of the sealing member with respect to the edge portion of the powder opening when the first restricting portion of the open/close lid contacts the contact surface.

13. A powder processing apparatus, comprising:

a powder processing apparatus casing including a container receiver; and a powder container that is detachably attached to the container receiver and houses powder, wherein the powder container includes a container body that houses the powder, the container body having an opening that is formed in a portion of the container body at a position corresponding to a powder opening that is formed in the container receiver, an open/close lid that is movable between an open position at which the opening is open and a close position at which the opening is closed, a first restricting portion that is provided at a portion of the open/close lid at a position at a forward side in an attachment operation direction of the container body, a contact surface being located upstream of the powder opening of the container receiver in the attachment operation direction of the container body and being formed to intersect with an open/close operation direction of the open/close lid, the first restricting portion being formed to face the contact surface, when the container body is attached to the container receiver, the first restricting portion being configured to contact the contact surface to restrict a position of the open/close lid in the open/close operation direction of the open/close lid; and a flexible sealing member having a protruding free end that protrudes from an edge of the open/close lid near the opening when the open/close lid is located at the open position at which the opening is open, the protruding free end contacting an edge portion of the powder opening and closing a portion, which is located near the opening, of a gap between the contact surface and the first restricting portion; and wherein the container receiver of the powder processing apparatus casing includes a press member that, when the container body is detached from the container receiver, restricts movement of the open/close lid in a detachment direction of the container body until the open/close lid reaches the close position at which the opening is closed, and wherein the powder container further includes a second restricting portion that, when the container body is detached from the container receiver and when the press member restricts the movement of the open/close lid, restricts a posture of the sealing member such that the protruding free end of the sealing member is pressed against the edge portion of the powder opening at a position at which the first restricting portion contacts the contact surface.

14. The powder processing apparatus according to claim 13, wherein the container receiver of the powder processing apparatus casing further includes a lid guide rail that guides a moving path of the open/close lid of the powder container, a lid movably holding mechanism that contacts the open/close lid, moves the open/close lid toward the open position, and then holds the open/close lid when the attachment of the powder container is completed, and also moves the open/close lid at the open position toward the close position by pressing the open/close lid by the press member when the powder container is detached, and a lid releasing mechanism that releases a holding state by the lid movably holding mechanism when the powder container is detached and when the open/close lid has reached the close position.

15. The powder processing apparatus according to claim 14, wherein a>b is satisfied, where b is a gap between the open position of the open/close lid provided by the lid movably holding mechanism and the open/close lid, and a is a protruding length of the sealing member from a contact portion of the sealing member with respect to the edge portion of the powder opening when the first restricting portion of the open/close lid contacts the contact surface.

16. A powder container controlling method with which a powder container with powder inside is detachably attached to a container receiver of a powder processing apparatus casing, the powder container including a container body that houses the powder and an open/close lid, the container body having an opening that is formed in a portion of the container body at a position corresponding to a powder opening that is formed in the container receiver, the controlling method comprising:

moving the open/close lid between an open position at which the opening is open and a close position at which the opening is closed;

restricting, when the container body is attached to the container receiver, a position of the open/close lid in an open/close operation direction of the open/close lid by configuring a first restricting portion to contact a contact surface, the first restricting portion being provided at a portion of the open/close lid at a position at a forward side in an attachment operation direction of the container body, the contact surface being located upstream of the powder opening of the container receiver in the attachment operation direction of the container body and being formed to intersect with an open/close operation direction of the open/close lid, the first restricting portion being formed to face the contact surface;

contacting an edge portion of the powder opening and closing a portion, which is located near the opening, of a gap between the contact surface and the first restricting portion with a protruding free end of a flexible sealing member, when the open/close lid is located at the open position at which the opening is open, the protruding free end protruding from an edge of the open/close lid near the opening; and restricting, with a second restricting portion, a posture of the sealing member such that the protruding free end of the sealing member is pressed against the edge portion of the powder opening at a position at which the first restricting portion contacts the contact surface, when the container body is detached from the container receiver and when a press member restricts the movement of the open/close lid, the press member being provided at the container receiver and restricting movement of the open/close lid in a detachment direction of the container body until the open/close lid reaches the close position at which the opening is closed.

* * * * *